US007786895B2

(12) United States Patent
Zoladek et al.

(10) Patent No.: US 7,786,895 B2
(45) Date of Patent: Aug. 31, 2010

(54) MULTI-USER MOTOR VEHICLE TELEMETRIC SYSTEM AND METHOD

(76) Inventors: Jacek Grzegorz Zoladek, 3681 Levadia Avenue, Ottawa, Ontario (CA) K1T 1L6; Colin David Goodall, 276 William Street, Carleton Place, Ontario (CA) K7C 1X3; Douglas John Preece, 101 Gemmill Street, Clayton, Ontario (CA) K0A 1P0; Gary Thomas Pepper, 417 Amberwood Road, R.R.#3, Ashton, Ontario (CA) K0A 1B0

( * ) Notice: Subject to any disclaimer, the term of this patent is extended or adjusted under 35 U.S.C. 154(b) by 530 days.

(21) Appl. No.: 11/571,273

(22) PCT Filed: Jul. 21, 2005

(86) PCT No.: PCT/CA2005/001150

§ 371 (c)(1),
(2), (4) Date: Dec. 25, 2006

(87) PCT Pub. No.: WO2006/012730

PCT Pub. Date: Feb. 9, 2006

(65) Prior Publication Data

US 2008/0012725 A1 Jan. 17, 2008

Related U.S. Application Data

(60) Provisional application No. 60/592,948, filed on Aug. 2, 2004.

(51) Int. Cl.
*G08C 19/22* (2006.01)

(52) U.S. Cl. ..... 340/870.07; 701/29; 701/34; 340/438

(58) Field of Classification Search ..... 340/870.07, 340/905, 425.5, 438, 441, 531; 701/29, 33, 701/32, 34; 455/95, 99
See application file for complete search history.

(56) References Cited

U.S. PATENT DOCUMENTS 5,809,437 A * 9/1998 Breed ..... 701/29

(Continued)

OTHER PUBLICATIONS

ANSI.IEEE Standard 802.11, 1999 Edition (R2003), Part 11:Wireless LAN Medium Access Control (MAC) and Physicla Layer (PHY) Specifications, Reaffirmed Jun. 12, 2003.

(Continued)

*Primary Examiner*—Albert K Wong

(57) ABSTRACT

A multi-user vehicle telemetric system comprises vehicle interface units (VIUs), wireless gateways, and one or more central hosts. The VIU in a vehicle collects data over the OBD-II bus and stores the data in the form of DataPoint Records (DPRs) in an on-board non-volatile (e.g. flash) memory. When the VIU is within wireless range of a gateway, it establishes a WiFi (802.11b) connection with the gateway, and submits stored DPRs to the gateway, to be stored in permanent storage at the gateway. Although the DPRs are stored in permanent storage on the gateway, they are deleted from permanent storage on the gateway after they are successfully uploaded to the central hosts. The gateways are shared, and communicate with the central hosts over a wide area network (WAN). When a gateway has gathered new DPRs from a VIU, it submits these to selected central hosts. The central hosts collect vehicle data for a plurality of users, each user being assigned a central host exclusively, or sharing a central host with other users. Each of the VIUs may be exclusively accessed by a single user or a number of users, and the shared gateways forward DPRs from a VIU only to the central hosts of the users which are authorized to access the VIU.

31 Claims, 11 Drawing Sheets

U.S. PATENT DOCUMENTS

| | | | | |
|---|---|---|---|---|
| 6,115,654 | A * | 9/2000 | Eid et al. | 701/34 |
| 6,856,820 | B1 * | 2/2005 | Kolls | 455/575.9 |
| 7,123,164 | B2 * | 10/2006 | Zoladek et al. | 340/870.07 |
| 7,502,672 | B1 * | 3/2009 | Kolls | 701/29 |

OTHER PUBLICATIONS

SAE (Society of Automotive Engineers) Surface Vehicle Recommended Practice, SAE J2190 issued Jun. 25, 1993.

SAE (Society of Automotive Engineers) Surface Vehicle Standard, SAE J1979, issued Dec. 1991, revised Apr. 2002.

* cited by examiner

Ownership

Central Hosts

Gateways

Vehicles (VIUs)

Ownership

Central Hosts

Gateways

Vehicles (VIUs)

500

502

| field | example value | description |
|---|---|---|
| VIUPoint_NAME | Gate9 | Gateway name |
| VIUPoint_ID | 2 | Gateway ID registered with Central Host 'CHost1' |
| OVERVIU_NAME | CHost1 | Central Host name |
| OVERVIU_ID | 1 | Central Host ID of 'CHost1' |
| PROVIDER_NAME | Company A | Name of user for 'Gate9' |
| PROVIDER_ID | 1 | User ID of 'Company A' |
| VIUPoint_ID | 21 | Gateway ID registered with Central Host 'CHost2' |
| OVERVIU_NAME | CHost2 | Central Host name |
| OVERVIU_ID | 2 | Central Host ID of 'CHost2' |
| PROVIDER_NAME | Company B | Name of user for 'Gate9' |
| PROVIDER_ID | 2 | User ID of 'Company B' |

504 504

506 508 510 512 514 506 508 510 512 514

FIG. 3

820

| 804 | | | 806 | 808 | | | | | 810 | 812 |
|---|---|---|---|---|---|---|---|---|---|---|
| VIU id | VIU serial number | VIU description | Programmed profile_id | Present profile id | Last VIU record | Last central host record | VIU synch time stamp | Central host synch time stamp | VIU state | Gateway id | Central host id |
| 4 | NTX 0030012 910017 | C-VIU Vehicle #8721 | 11 | 11 | 29290 0521 | 29290 0521 | 1/26/ 2004 12:47: 39 pm | 1/26/ 2004 12:47: 39 pm | Active | 2 | 1 |
| 4 | NTX 0030012 910017 | C-VIU Vehicle #8721 | 12 | 12 | 29290 0521 | 29290 0521 | 1/26/ 2004 12:47: 41 pm | 1/26/ 2004 12:47: 41 pm | Active | 21 | 2 |
| additional VIU/central host entries . . . | | | | | | | | | | | |

*FIG. 8*

900

| Profile_id | Profile_name | Profile_description | Service_id | Profile_data | Profile_timestamp |
|---|---|---|---|---|---|
| 1 | Empty Profile | stub profile | 1 | Place holder | 6/2/2005 4:22:57 pm |
| 2 | Simulator Base | Test Car Basic Simulator Profile | 1 | Data for L1 | 6/2/2005 4:23:32 pm |
| 3 | Simulator Enhanced | Test Car Enhanced Simulator Profile | 1 | Data for L2 | 6/2/2005 4:23:32 pm |
| 4 | Simulator Diagnostics | Test Car Diagnostics Simulator Profile | 1 | Data for L3 | 6/2/2005 4:23:32 pm |
| 5 | T1 Test Profile | Profile for testing VIU devices | 1 | Sample profile data | 6/2/2005 4:23:32 pm |
| additional profile entries . . . | | | | | |

FIG. 9

MULTI-USER MOTOR VEHICLE TELEMETRIC SYSTEM AND METHOD

RELATED APPLICATIONS

This application claims benefit from the U.S. provisional application Ser. No. 60/592,948 to Zoladek entitled "Vehicle Telemetric System Providing Filtering Of Collected Data And Distribution Thereof To Multiple Consumers" filed on Aug. 2, 2004, and from the U.S. patent application Ser. No. 10/909,007 to Zoladek entitled "Vehicle Telemetric System" filed on Aug. 2, 2004.

FIELD OF THE INVENTION

The invention relates to motor vehicle telemetric systems in which an on-board computer transmits vehicle related data to one or more central host computers over a wireless network.

DESCRIPTION OF THE RELATED ART

In recent years, most motor vehicles have been equipped with on-board computers connected to sensors located in various systems in the motor vehicle, for example the engine, the exhaust system, and the like.

The Society of Automotive Engineers (SAE) has set standards which include a standard connector plug and a set of diagnostic test signals that vehicle repair facilities use when adjusting or repairing the motor vehicle. The standard connector plug and set of test signals, today, is known collectively as OBD-II (On-Board-Diagnostic, version 2) which applies to all cars and light trucks built in North America after Jan. 1, 1996.

The on-board computers may also be coupled through the OBD-II interface to an on-board equipment containing a wireless modem, and thence to a wireless communications network to enable interested parties to remotely obtain diagnostic and other information from the motor vehicle. The applications for accessing the vehicle on-board computers remotely include highway monitoring of emission levels, surveillance of fleet vehicles from a central location for purposes of performance tracking and maintenance scheduling, and other applications.

Depending on the application, various ways are possible in which the wireless connectivity between the vehicle and a computer host at a monitoring location (to be referred to as the central host) can be achieved. For example the wireless modem may be configured to operate in the manner of a cellular telephone, and use the cellular telephone network to connect to any central host equipped with access to the telephone network. Similarly, the wireless modem may be configured to access the central host over a Wide Area Network (WAN), for example the Internet. One example of a system for transmitting, collecting and displaying diagnostic and operational information from one or more motor vehicles to a central server connected to a wide area network, for example is described in U.S. Pat. No. 6,295,492, issued to Lang, et al.

A previously filed U.S. patent application of the same Applicant Ser. No. 10/909,007 filed Aug. 2, 2004 and entitled "Vehicle Telemetric System" (inventors Zoladek et al), which is hereby incorporated by reference in its entirety, discloses a reliable and efficient method of effective data communication between a vehicle and a central host, including a method for providing continuity of information in a motor vehicle telemetric system over localized wireless networks (WLANs), to permit the central host to collect diagnostic and other data from a vehicle, even when wireless access is intermittent.

The data that may be remotely collected from vehicles may be of interest to numerous different concerns ("users"), such as government agencies, manufacturers, service companies, and the owners of the vehicles, especially of fleets of vehicles. At present, separate independent systems may be used by the different users, to collect data that is of interest to them individually, leading to a duplication of effort and higher cost. Furthermore, it may be too costly or not be possible at all to install additional systems for different users on the same vehicle. Such users may be able to obtain the collected data indirectly from the primary operator of the vehicle data collection system, but without having direct and immediate control over the data so obtained.

What is needed to be developed is a system and method for providing efficient wireless collection of vehicle data in a way that permits multiple users to independently obtain vehicle data in a timely manner, and alternatively also permits a primary operator to provide multiple virtual systems to multiple users.

SUMMARY OF THE INVENTION

It is an objective of the present invention to provide a multi-user motor vehicle telemetric system.

According to one aspect of the invention, there is provided a multi-user motor vehicle telemetric system, comprising:

(a) one or more central hosts connected to a communications network, each central host being associated with one or more users of the system;

(b) one or more gateways connected to the communications network, the communications network enabling the transfer of data between the gateways and the central hosts;

(c) one or more vehicle interface units (VIUs), each placed within a vehicle having access to sensors in the vehicle for collecting vehicle related data, each VIU having means for communication over a wireless link to gateways designated to be accessed by said each VIU when the VIU of the vehicle is within a transmission range of one of said designated gateways, and wherein each VIU is associated with one or more of the users;

(d) each central host having means for selecting gateways for collecting data from each VIU which is associated with the users that the central host is associated with;

(e) each central host having means allowing each user to specify the data to be collected from its associated VIUs through a data collection profile which is stored in the central host and the selected gateways;

(f) each gateway having means for recognizing the association between central hosts and VIUs belonging to the same user; and (g) each VIU having a means for collecting the data, which is required to be collected according to a combined data collection profile for all users associated with said each Vru.

Conveniently, the means (g) comprises a means for collecting the data, which is required to be collected according to a combined data collection profile, which is formed so that to avoid a duplication of data to be collected by each VIU between the users associated with said each VIU. In the system described above, some or all of the selected gateways may be shared between two or more users. For example, all gateways may be shared by all users. The selected gateways process the collected data according to the data collection profiles related to each of the users, and forward the processed data to the central hosts associated with the respective users.

The system described above may have only one central host, or some users of the system may be associated with more than one central host, or each host may be associated with only one user.

Each gateway has means for determining the associated VIUs and the central hosts, wherein such means for determining includes means for processing the data received from the associate VIUs and forwarding respective subsets of the data to associated central hosts according to the data collection profiles related to each user that the central host is associated with. Additionally, the means for determining comprises a database stored in a computer memory along with a software for data processing.

The means in the VIU comprises a data collection table stored in a memory and a control program therefor. The data collection table comprises an entry for each type of data to be collected, and a collection specification regarding the time interval and the condition for performing the data collection and storage for each type of data to be collected. The entry for each type of data to be collected comprises a value identifier linking the type of data to be collected and the collection specification to the data collection profile. Preferably, the entry for each type of data comprises designations specified by SAE (Society of Automotive Engineers), and the access to sensors is provided by an OBD-II bus or its equivalent. Other non-OBD-II data can also be obtained by the VIU, e.g. Global Positioning System (GPS) data.

According to another aspect of the invention there is provided a gateway for a multi-user motor vehicle telemetric system, comprising one or more central hosts connected to a communications network, each central host being associated with one or more users of the system and one or more vehicle interface units (VIUs), each placed within a vehicle having access to sensors in the vehicle for collecting vehicle related data, each VIU having means for communication over a wireless link to the gateway, each VIU is associated with one or more of the users, the gateway serving more than one user, the gateway comprising:

(a) means for determining if the gateway is authorized to be accessed by said each VIU when the VIU of the vehicle is within a transmission range of said gateway, (b) means for receiving the collected vehicle related data from said VIU, and processing and forwarding the processed data to the central hosts associated with same users that said each VIU is associated with, in accordance with data collection profiles which are specific to each user.

In the gateway described above, the means (a) comprises a database stored in a computer memory along with a software for data processing.

According to yet another aspect of the invention there is provided a vehicle interface unit (VIU) for a multi-user motor vehicle telemetric system, comprising one or more central hosts connected to a communications network, each central host being associated with one or more users of the system, one or more gateways connected to the communications network, the communications network enabling the transfer of data between the gateways and the central hosts, the VIU being placed within a vehicle and having access to sensors in the vehicle for collecting vehicle related data, the VIU further having means for communication over a wireless link to gateways to be accessed by the VIU when the VIU of the vehicle is within a transmission range of one of said gateways, and wherein each VIU is associated with one or more of the users, each central host having means allowing each user to specify the data to be collected from its associated VIUs through individual data collection profiles which are stored in the central host and the gateways and forming a combined data collection profile forwarded to the VIU, the VIU comprising:

(a) means for storing the combined data collection profile; and (b) means for collecting the data required to be collected from the vehicle according to the combined data collection profile for all users associated with said VIU.

The combined data collection profile comprises a data collection table stored in a memory and a control program therefor. The data collection table comprises an entry for each type of data to be collected, and a collection specification regarding the time interval and the condition for performing the data collection and storage for each type of data to be collected. The entry for each type of data to be collected comprises a value identifier linking the type of data to be collected and the collection specification to the data collection profile. The entry for each type of data comprises designations specified by SAE (Society of Automotive Engineers), and the access to sensors is provided by OBD-II bus or its equivalent. Other non-OBD-II data can also be obtained by the VIU, e.g. Global Positioning System (GPS) data.

According to one more aspect of the invention there is provided a method for collecting vehicle performance data in a multi-user motor vehicle telemetric system, comprising one or more central hosts connected to a communications network, each central host being associated with one or more users of the system, one or more gateways connected to the communications network, the communications network enabling the transfer of data between the gateways and the central hosts, one or more vehicle interface units (VIUs), each placed within a vehicle having access to sensors in the vehicle for collecting vehicle related data, each VIU having means for communication over a wireless link to gateways designated to be accessed by said each VIU when the VIU of the vehicle is within a transmission range of one of said designated gateways, and wherein each VIU is associated with one or more of the users, the method comprising:

(a) at each central host, selecting gateways for collecting data from each VIU which is associated with the users that the central host is associated with;

(b) at each central host specifying for each user the data to be collected from its associated VIUs through data collection profiles which are stored in the central host and the selected gateways;

(c) at each gateway determining the association between central hosts and VIUs belonging to the same user; and (d) at each VIU, collecting the data required to be collected according to a combined data collection profile for all users associated with said each VIU.

The method further comprising the steps of:

receiving the collected data from said each VIU;

determining the central hosts which have the same user as the VIU;

for each host, filtering the collected data according to the data collection profile for that host; and forwarding the filtered data to said each central host.

Conveniently, the step of filtering comprises decoding and storing the data. Beneficially, the method further comprises the step of forming a data collection table based on the combined data collection profile, the data collection table comprising an entry for each type of data to be collected, and a collection specification regarding the time interval and the condition for performing the data collection and storage for each type of data to be collected. The step of forming comprises introducing for each type of data to be collected a value identifier linking the type of data to be collected and the collection specification to the data collection profile.

The step (d) of the method described above comprises reading the data collection table, and for each type of data to be collected and the collection specification, collecting the data accordingly and storing it in a memory.

Thus, a Multi-User Motor Vehicle Telemetric System and Method have been provided.

BRIEF DESCRIPTION OF THE DRAWINGS

The invention will now be described in greater detail with reference to the attached drawings, in which:

FIG. 3 illustrates the format of a gateway VIUPointS table 500 stored in a gateway of the multi-user vehicle telemetric systems 60, 70, 80, and 90;

Figure 7:
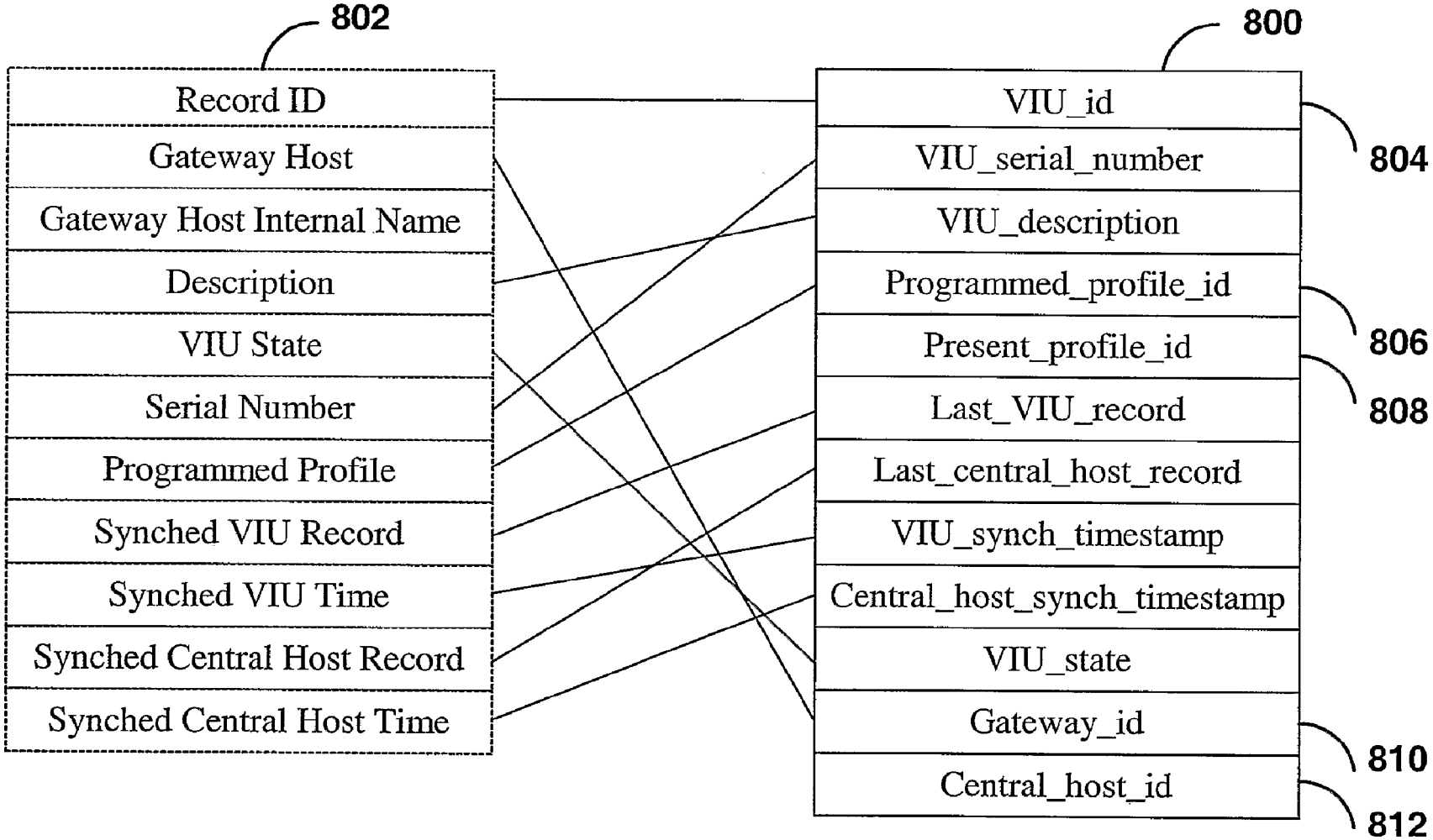
FIG. 7 shows the format of a Modified VIUs table 800 stored in a gateway of the multi-user vehicle telemetric systems 60, 70, 80, and 90.
Figure 10:
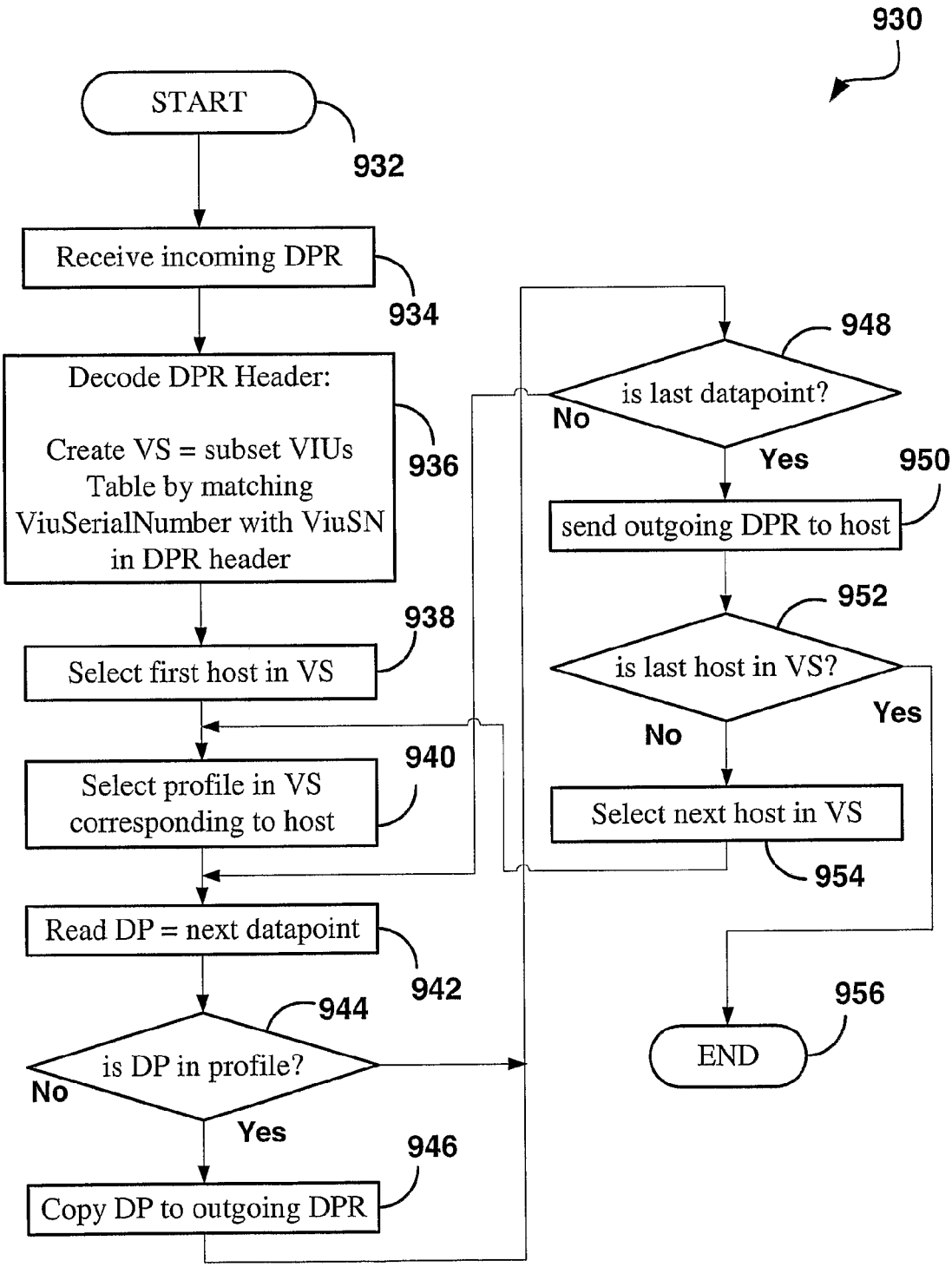

The FIG. 8 shows an illustrative example 820 of the Modified VIUs table 800 of FIG. 7;

FIG. 9 shows an example of a Profiles Table 900 stored in a gateway of the multi-user vehicle telemetric systems 60, 70, 80, and 90; and FIG. 10 shows a Forwarding Process 930 of a gateway of the multi-user vehicle telemetric systems 60, 70, 80, and 90.

DETAILED DESCRIPTION OF THE PREFERRED EMBODIMENTS

Figure 1:
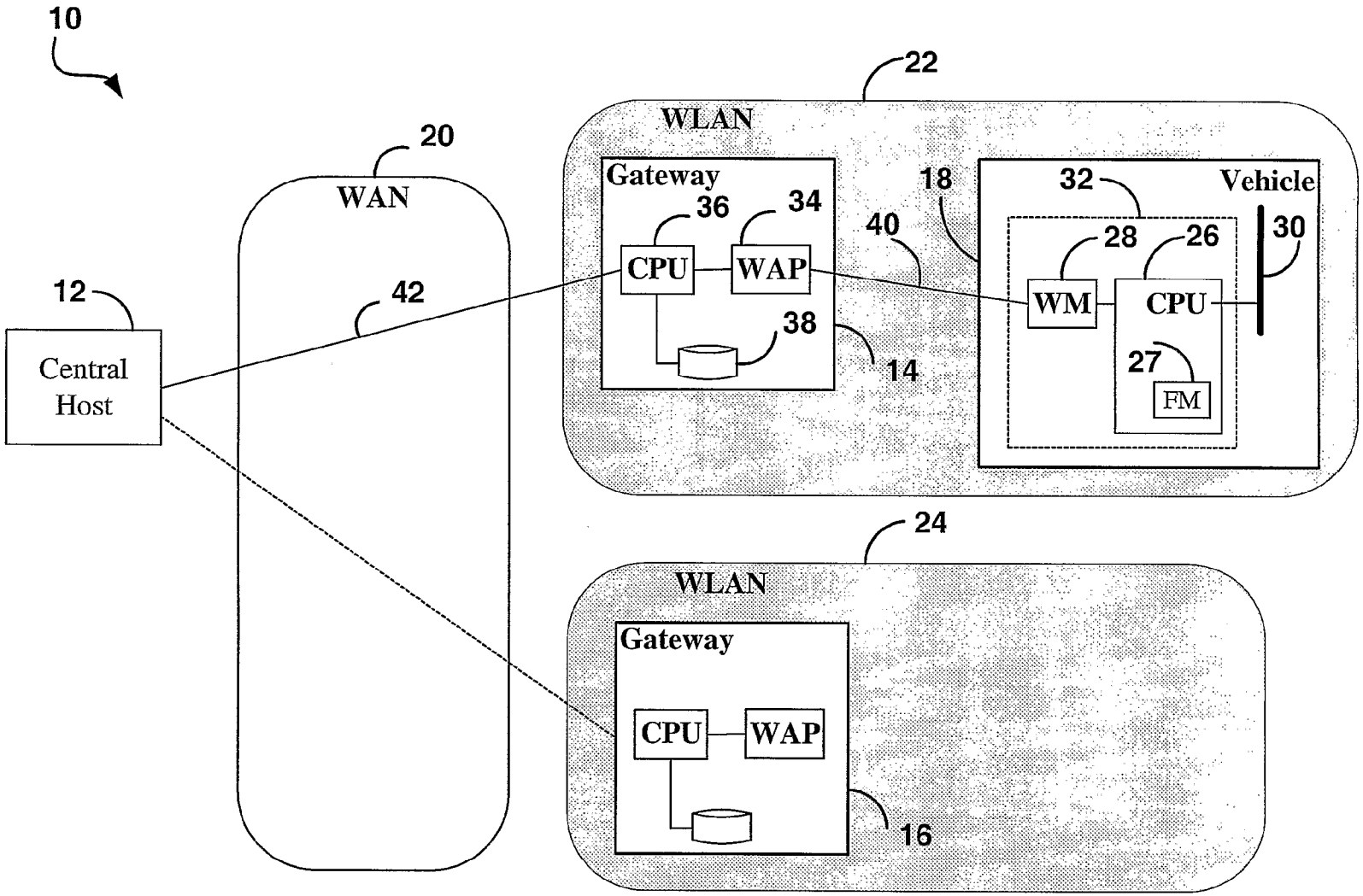
FIG. 1 shows the architecture of a vehicle telemetric system 10.

A brief description of a motor vehicle telemetric system is provided in the previously filed U.S. patent application to the same Applicant cited above. FIG. 1 of this application is repeated here for convenience, since it also forms the system upon which the present invention is based. FIG. 1 shows the architecture of a vehicle telemetric system 10, including a central host 12, a first gateway 14, a second gateway 16, and a vehicle 18. The second gateway 16 is similar to the first gateway 14. The gateways 14 and 16 are connected with the central host 12 over a wide area network (WAN) 20. The coverage area of a first Wireless Local Area Network (WLAN) 22 exists around the first gateway 14. Similarly, the coverage area of a second WLAN 24 exists around the second gateway 16.

The vehicle 18 is shown inside the coverage area of the first WLAN 22, and thus within reach of the first gateway 14.

The vehicle telemetric system 10 may include additional gateways (not shown) having additional coverage areas of additional WLANs (not shown), and includes additional vehicles (not shown).

At some other time (not shown) the vehicle 18 is inside the coverage area of the second WLAN 24, and thus within reach of the second gateway 16.

At yet another time (not shown), the vehicle 18 may be outside the coverage area of the WLANs 22 and 24, and also outside the coverage area of the any other WLAN of the vehicle telemetric system 10. In this case the vehicle is not within reach of any gateway.

The vehicle 18 includes an on-board computer (CPU) 26 having a non-volatile (e.g. flash) memory (FM) 27; a wireless modem (WM) 28; and a vehicle bus (e.g. ODB-II) 30. The combination of the on-board computer 26 and the wireless modem 28 will also be referred to as a Vehicle Interface Unit (VIU) 32. The on-board computer 26 is connected to the wireless modem 28, and to the vehicle bus 30.

The first gateway 14 includes a wireless access point (WAP) 34 and a gateway computer 36 with a gateway storage 38. The gateway storage 38 is preferably implemented as permanent storage on a hard disk.

Similarly, the second gateway 16 and any additional gateways (not shown) each include a WAP and a gateway computer with data storage.

When (as shown in FIG. 1) the vehicle 18 is within reach of the first gateway 14, a WiFi link 40 may be established between the on-board computer 26 in the vehicle 18 and the gateway computer 36 in the gateway 14, by way of the wireless modem 28 and the WAP 34.

In the preferred embodiment, the WLANs 22, 24, and the additional WLANs, of the vehicle telemetric system 10 operate according to the IEEE 802.11b wireless LAN standard, and accordingly the wireless modem 28 of the vehicle 18, and the WAPs of all gateways, including the WAP 34 of the gateway 14, follow the same standard.

A central connection 42 may be established between central host 12, and the gateway computer 36 in the gateway 14, by way of the WAN 20. The establishment of the central connection 42 from time to time is automatic, according to the state of the art. For the purposes of this description, the central connection 42 is assumed to exist whenever it is needed. In the preferred embodiment, the WAN 20 is the Internet.

General Operation of a (Single User) Vehicle Telemetric System

The operation of the vehicle telemetric system 10 is described fully in the previously filed U.S. patent application to the same Applicant cited above, and will only be summarized here.

The VIU 32 in the vehicle 18, whether within wireless transmission range of a gateway or not, is programmed to periodically collect vehicle data from the vehicle bus 30, and store the data in the flash memory 27 of the CPU 26. The data is in the form of DataPoint Records (DPR), described in said previously filed application to the same Applicant cited above, see FIG. 2 thereof. A purpose of the vehicle telemetric system 10 is to reliably an efficiently convey the DPRs from the VIU 32 in the vehicle 18 to the central host 12.

Whenever the vehicle 18, or equivalently any other vehicle equipped with a VIU, is inside the coverage area of the first WLAN 22, and thus within reach of the first gateway 14, or equivalently any other WLAN and corresponding gateway, a data exchange between the vehicle and the gateway ensues after a connection between the vehicle and the gateway is established. Previously collected vehicle data that was stored in the vehicle's flash memory, is then transmitted to the gateway in the form of DPRs, and forwarded from the gateway to the central host 12. As described in more detail in said previously filed application to the same Applicant cited above, the data is collected from the gateway only if the gateway notifies the central host that it has data and the central host determines that it needs some or all of the data. If the central host already has the data, it will not request it. If multiple hosts have an interest in the data, then all the multiple hosts have to be notified in this manner. The data is not deleted from the gateway until all multiple hosts that have an interest in the data are notified and they all have responded with the message equivalent to "The data has been received and the DPR(s) can be deleted now".

As described in said previously filed application to the same Applicant cited above, DPRs are collected by the vehicles' VIUs, forwarded by the gateways, and received by the central host, while ensuring the continuity of the data even as the vehicles move, from time to time, into and out of the wireless transmission range of any of the gateways of the vehicle telemetric system 10.

Also described in said previously filed application to the same Applicant cited above, is the concept of "pertinent" gateways. The vehicle telemetric system 10 is capable of serving a large number of vehicles, and contains a large number of gateways. The vehicles may be grouped into fleets according to owners, or other criteria. The gateways may be distributed over a large territory, and not every gateway is necessarily enabled to serve every vehicle or vehicle fleet. Thus, a "pertinent" gateway with respect to a specific vehicle is a gateway that is enabled or designated to serve the specific vehicle, or conversely, a gateway that a specific vehicle (i.e. the VIU in it) is authorized to access.

While the system described in the previously filed application to the same Applicant cited above provides a homogeneous system with some potential for regional management or multiple fleet management (for example), the present invention provides additional concepts, such as "shared" gateways as well as multiple central hosts and "shared" central hosts, that will allow multiple users to share communications and processing resources. Briefly summarized, the goal is to provide a system and a method to allow many combinations of dedicated and shared gateways, and multiple and shared central hosts, to serve multiple users in the collection of vehicle data. Each user will have the experience of a complete system (a virtual system consisting of central host, gateways, and vehicles with VIUs) while the physical equipment may be shared with other users.

General Operation of a Multi-User Vehicle Telemetric System

In FIGS. 2A, 2B, 2C, and 2D are depicted four examples of multi-user vehicle telemetric systems showing four scenarios for using multiple gateways with multiple central hosts. It should be noted that vehicles, being mobile may also belong to (be accessible from) one or more of the virtual systems as well as the physical systems, whenever they are within wireless transmission range of a (physical) gateway of any of the systems. These four systems are merely examples, various other permutations and combinations can be constructed by 'mixing' the topologies illustrated in these figures. In all these scenarios, it is assumed that all VIUs (which may belong to different companies) are configured with the same protocol (IEEE 802.11b) and the same keys (WEP and SSID keys, see IEEE 802.11b protocol specification), so that they can communicate with any of the gateways through their respective WAPs (wireless access points, see above).

The same WEP and SSID keys are used in the particular scenario described. In a variation, not further described in detail, WEP and SSID keys can be used to prevent some 'unwanted' vehicles from communicating with a gateway, for example. Furthermore, some WiFi WAPs (gateways) have multiple WEP/SSID support and traffic can be directed to various IP addresses (routing) based upon the WEP and SSID.

Three types of gateways (each containing a WAP) are defined, private gateways, shared gateways, and public gateways:

- a private gateway located on a private corporate physical premises and only VIUs belonging to the same corporate entity (user) upload data via that gateway;
- a shared gateway located on private corporate premises and (by prior agreement) two or more users can upload data via that gateway; and
- a public gateway operated in a public physical space (such as at a gas station) through which users (also by prior arrangement) can upload VIU data.

The group of gateways, regardless of their type, that are able or authorized to access a specific central host are the selected gateways of that central host. The premises and the gateway may also be supplied by a third party service provider.

Different topologies were created to provide flexibility for users in the following ways: multiple users with their own VIUs could utilize any combination of private, shared and public wireless gateways to upload VIU data, while maintaining the privacy of their data. The vehicle data gathered from shared gateways is directed only to the intended user's central host (or central hosts), mandated by the individual users. Data privacy is always ensured.

Flexible central host configurations are possible. For example, a hosted central host (either run by Netistix or by a third party provider) can have data for multiple users residing on it. Alternatively, some users may operate their own central host system residing in their own premises, because of privacy concerns or because they may already have an extensive Information Technology (I.T.) infrastructure.

Another user may require multiple central hosts, which may or may not contain the same database information about their corporate VIUs. For example, a national corporate entity may have a head office and regional offices. It may desire the regional offices to have central hosts that only contain information about the VIUs in their respective regional vehicles. The head office may wish to have a central host that contains VIU information for the entire corporate fleet.

It is important to efficiently utilize the available bandwidth for any central host/gateway/VIU network topology. Any gateway can potentially accept or reject information from any VIU (depending upon the configuration) and can direct VIU data to any number of central hosts (again, depending upon the configuration).

No matter what the configuration, the security of individual user's data is ensured.

The implementation aspects of the flexible multi-user system are described in detail in the following sections. The term "user" will be used to denote the entity (usually a company) who receives collected vehicle data in a central host, and has access to the data. The data thus "belong" to the user. The physical central host may belong to the user, or it may be shared with other users, it may also be operated by a owner/user on behalf of other users. The vehicles (i.e. the VIUs in the vehicles) have a relationship with the users, for example a vehicle may be owned by a user, and only that user is authorized to access the vehicle data. Vehicle data may also be accessible to more than one user. Each user may have an interest in a different set of vehicle data from the same vehicles. A "user profile" defines a set of vehicle data of interest to a particular user.

In summary then, users are associated with (have access to) usually one central host but association with more than one central host is also possible, while at the same time a central host may be dedicated to (associated with) one user, or it may be shared and thus associated with several users. In a similar way there is an association between vehicles and users such that a vehicle is associated with a single user or several users.

The primary function of the gateways is to relay data from vehicles (VIUs) to central hosts, as described in detail in said previously filed application to the same Applicant cited above. While gateways are managed from a central host, once operational they pass data (possibly filtered or processed in a certain way) between VIUs and central hosts.

Multi-user Vehicle Telemetric Systems

The FIGS. 2A, 2B, 2C, and 2D illustrate example configurations of multi-user vehicle telemetric systems 60, 70, 80, and 90 respectively. Each Figure is divided into three interconnected areas, central hosts, gateways, and vehicles containing VIUs, with letters 'A' to 'C' and the letter 'N' indicating ownership of the equipment or the data residing in the equipment or flowing on the communications links.

Figure 2B:
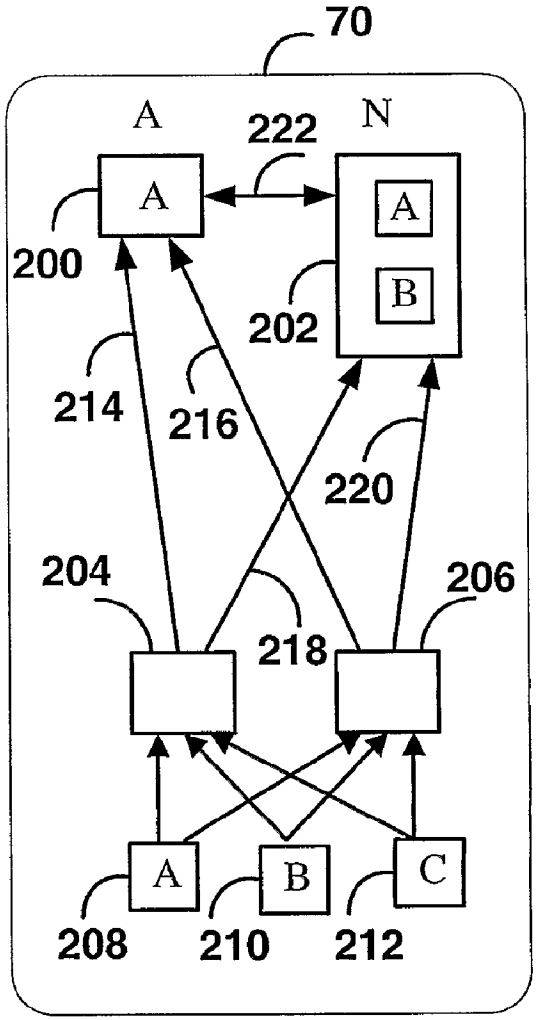
FIG. 2B shows a multi-user vehicle telemetric system 70 with multiple central hosts.
Figure 2A:
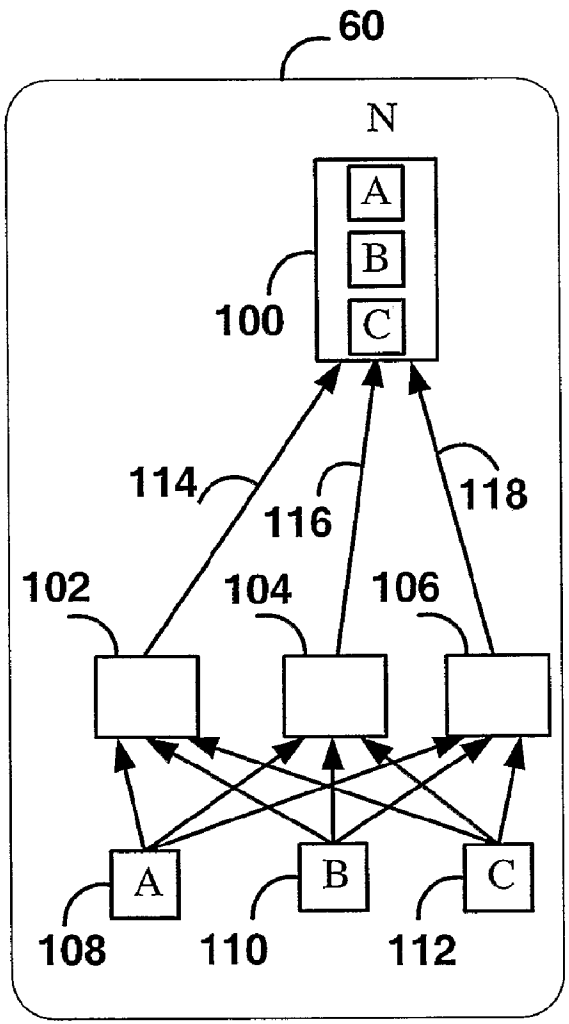
FIG. 2A shows a multi-user vehicle telemetric system 60 with a shared central host and shared gateways.

The multi-user vehicle telemetric system 60 shown in FIG. 2A comprises a single central host 100, three gateways 102, 104, and 106, and three vehicles (each containing a VIU) 108, 110, and 112 to be served by three different users 'A', 'B', and 'C' respectively, that is the vehicle data the vehicle 108 "belongs" to the user 'A' and so on. The central host 100 is owned and operated by the entity indicated by the letter 'N' (Netistix). It is designed to serve three different users (customers of 'N') 'A', 'B', and 'C', to collect and store vehicle data on behalf of these users. The illustration of the central host 100 indicates that data are kept separately for the three users 'A', 'B', and 'C', in three separate data areas labeled with the corresponding letters within the central host 100. The three gateways 102, 104, and 106, are linked to the central host 100, using WAN connections 114, 116, and 118. Each of the vehicles 108, 110, and 112, belonging to the respective users 'A', 'B', and 'C' are able to be linked to any one of the gateways 102, 104, or 106 whenever they are physically within wireless communication range with that gateway. Each of the links 114, 116, and 118 then carry data for all three users 'A', 'B', and 'C' as required, whenever a vehicle is in communication with a respective gateway 102-106.

FIG. 2A thus illustrates the scenario in which data from vehicles (108-112) is collected through multiple gateways (102-106) and relayed to a database residing on one central host 100. Multiple user's data ('A'-'C') can reside in the database. The gateways (102-106) may be operated as private, (usually a private gateway is configured with a truly unique WEP/SSID to prevent others from linking to the WAP), shared (a shared gateway could pass other users' data by mutual agreement), or public gateways. Data from VIUs belonging to companies (users) 'A', 'B' and 'C' can be uploaded from any of a number of gateways to be collected in a single database residing on a single central host. It should be noted that in this example only three gateways, and three vehicles are shown. In general, there may be any number of gateways, each configured as private, shared or public, and each of the users 'A', 'B', and 'C' may have many more vehicles. There may also be fewer or many more than three users.

The multi-user vehicle telemetric system 70 shown in FIG. 2B comprises two central hosts 200 and 202, two gateways 204 and 206, and three vehicles (each containing a VIU) 208, 210, and 212 to be served by three different users 'A', 'B', and 'C' respectively. The first central host 200 is owned and operated by the entity indicated by the letter 'A'. It is designed to serve only the user 'A' to collect and store vehicle data. The second central host 202 is owned and operated by the entity indicated by the letter 'N' (Netistix). It is designed to serve two users (customers of 'N') 'A' and 'B' to collect and store vehicle data on their behalf. The illustration of the central host 202 indicates that data are kept separately for the two users, in two separate data areas within the central host 202. The two gateways 204 and 206, are linked to both central hosts 200 and 202, using WAN connections 214 (gateway 204 to central host 200), 216 (gateway 206 to central host 200), 218 (gateway 204 to central host 202), and 220 (gateway 206 to central host 202). A link 222 joins the central hosts 200 and 202. Each of the vehicles 208, 210, and 212, belonging to the respective users 'A', 'B', and 'C' are able to be linked to either of the gateways 204 and 206 whenever they are physically within wireless communication range with that gateway. However, in this example, it is assumed that user 'C' has vehicles equipped with VIUs to have its data collected in a different telemetric system (not shown), thus communication from vehicle 212 (belonging to 'C') is blocked by the gateways 204 or 206 of the telemetric system of FIG. 2B even when wireless communication between the vehicle 212 and the gateways 204 or 206 is possible. The vehicles 208 and 210 however, belonging to the respective users 'A' and 'B' are able to be linked to any one of the gateways 204 and 206 whenever they are physically within wireless communication range with that gateway, and have their data forwarded. The links 214 and 216 (between the gateways 204 and 206 respectively, and the central host 200) carry only data for user 'A' to the central host 200 which belongs to 'A'. The links 218 and 220 carry data for both users 'A' and 'B' to the central host 202 which serves both users 'A' and 'B'. The user 'A' has data stored on both central hosts 200 and 202. The link 222 serves to keep the databases (with respect to data belonging to 'A') synchronized. If the gateways always have active links to the central hosts, then the databases should always be synchronized, within a few minutes of each other.

FIG. 2B thus illustrates the case of two central hosts communicating with multiple gateways. The database in the central host 200 contains only data for user 'A', while the database in the central host 202 (a hosted system, for example, owned and operated by Netistix or by another 3rd party) contains data for both users 'A' and 'B'. The user 'C' is blocked by both gateways 204 and 206, because 'C' has not been authorized to access this system. The 'access rights' are determined by configuration data held by the gateway and the central host (see further description below). The VIU does not have any idea of what gateways it is allowed to access. If the WEP and SSID match on both the VIU and the gateway, the VIU will attempt to establish communication. It is then up to the gateway to either respond to the VIU and request data or to ignore the VIU—if it hasn't been authorized.

The central hosts 200 and 202 in FIG. 2B contain duplicate database information for user 'A'. This can be achieved by the same VIU data being transmitted up to each central host (200 and 202) from each gateway (204 and 206), i.e. from any gateway that extracts data from a particular VIU (in vehicle 208) belonging to user 'A'. The duplication of database information from one central host (200 or 202) to the other can also be achieved by the replication function of the database (RDBMS=Relational Data Base Management System). This intrinsic replication ability of the database can be triggered via various methods, which are not relevant to the present discussion.

Figure 2D:
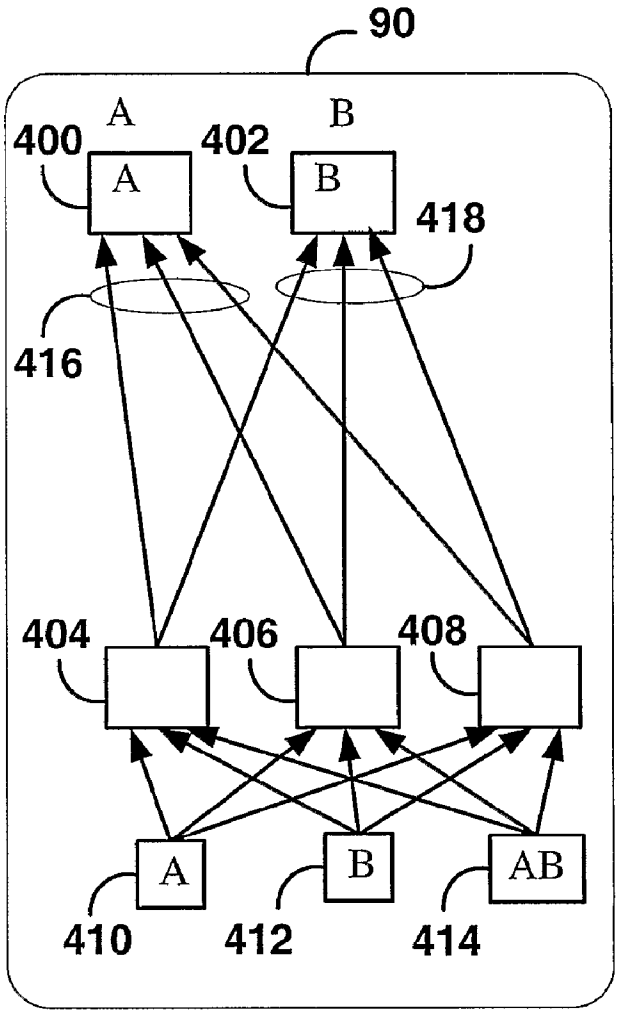
FIG. 2D shows a multi-user vehicle telemetric system 90 with two central hosts both having access to a vehicle.
Figure 2C:
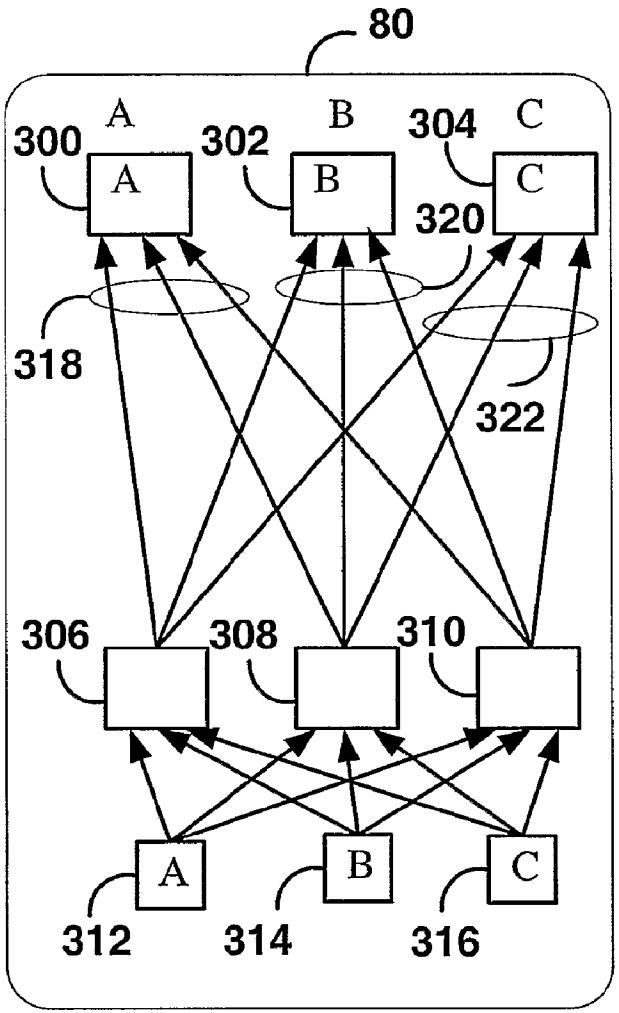
FIG. 2C shows another example of a multi-user vehicle telemetric system 80 with multiple central hosts.

The multi-user vehicle telemetric system 80 shown in FIG. 2C comprises three central hosts 300, 302, and 304, three gateways 306, 308, and 310, and three vehicles (each containing a VIU) 312, 314, and 316 to be served by three different users 'A', 'B', and 'C' respectively. The central hosts 300, 302, and 304 are owned and operated by three different users 'A', 'B', and 'C', to collect and store vehicle data on behalf of these users. They are each designed to serve only one user 'A', 'B', or 'C' respectively to collect and store vehicle data for them. The three gateways 306, 308, and 310 are each linked to all three central hosts 300, 302, and 304, using three groups of WAN links: group 318 containing a link from each gateway to the central host 300, group 320 containing a link from each gateway to the central host 302, and group 322 containing a link from each gateway to the central host 304. Each of the vehicles 312, 314, and 316, belonging to the respective users 'A', 'B', and 'C' are able to be linked to any of the gateways 306-310 whenever they are physically within wireless communication range with that gateway. Each of the three gateways 306, 308, and 310 then forward vehicle data received from vehicles only to the central host for which the data is intended. For example data from vehicle 312 (user 'A') that is received by the gateway 310 is forwarded only to the central host 300 (belonging to 'A') over the corresponding WAN link in the link group 318.

FIG. 2C thus illustrates the case where there are three separate central hosts, containing data for three different users; each user's data resides on a separate central host. All the gateways are shared (or public). All three users' VIUs can communicate with any of the gateways and VIU data is routed to the appropriate server (central host).

The multi-user vehicle telemetric system 90 shown in FIG. 2D comprises two central hosts 400 and 402; three gateways 404, 406, and 408; two vehicles (each containing a VIU) 410 and 412, to be served by users 'A' and 'B' respectively; and a third vehicle (with VIU) 414 to be served by either user 'A' or 'B'. The first central host 400 is an exclusive central host, owned and operated by the entity indicated by the letter 'A'. It is designed to serve only user 'A' to collect and store vehicle data for 'A'. Similarly, the second central host 402 is owned and operated by the entity indicated by the letter 'B'. It is designed to serve only user 'B' to collect and store vehicle data for 'B'. The gateways 404, 406, and 408 are linked to both central hosts 400 and 402, using WAN connections 416 (gateways 404, 406, and 408 to central host 400), and 418 (gateways 404, 406, and 408 to central host 402). Each of the vehicles 410, 412, and 414 is able to communicate through any of the gateways 404-408 whenever they are physically within wireless communication range with that gateway.

FIG. 2D thus illustrates the case where there are two users, each having an exclusive central host, and each being able to collect vehicle data from their own vehicles (as in FIG. 2C), but in addition being also able to collect vehicle data from some vehicles that they have both access to.

It should be understood that the scenarios (FIGS. 2A-D) are of an illustrative nature only; in each case the system may comprise more than the illustrated number of central hosts, gateways, and vehicles. Furthermore, the scenarios can also be combined to give rise to many combinations of multi-user telemetric systems.

The multi-user telemetric systems 60, 70, 80, and 90, shown in FIGS. 2A-2D are constructed using components that communicate over WANs and WLANs, namely central hosts, gateways, and VIUs (in vehicles). These components are enhanced versions of the corresponding components described in the previously filed application to the same Application cited above. After a brief summary, the enhancements are more fully described in the following.

Multi-user operation of the central hosts, such as those shown in FIGS. 2A and 2B, can be provided within standard operating systems (for example Windows NT server, or Unix) and databases (for example from Oracle); the gateways are equipped with various profile tables (see below) to allow data traffic to be filtered according to ownership, and routed to the appropriate central host or hosts; and the VIUs are equipped with a "Data Collection Table" controlling the set of vehicle data to be collected, according to the requirements of one or more users.

In the following description, frequent references will be made to 'central host', 'gateway', and 'VIU'. In each case, this reference applies to any of the central hosts, gateways, and VIUs of the multi-user telemetric systems 60, 70, 80, and 90, shown in FIGS. 2A-2D, or other multi-user telemetric systems that may be similarly implemented.

Central Host

When a particular central host in a multi-user vehicle telemetric system is dedicated to a single user, for example the central hosts 200 (system 70 in FIG. 2B) and 300-304 (system 80 in FIG. 2C) no central host enhancements are required since these hosts are not aware of the multi-user nature of the telemetric system as a whole. In this case the central host functionality described in the previously filed application to the same Applicant cited above suffices, although for practical reasons even a single-user central host may be configured as a multi-user central host with the number of users=1, to allow future expansion as well as keeping the software versions of all central hosts current.

The enhancement to provide a shared central host can be provided in a number of ways, commonly available to people skilled in the art of multi-user programming. As an example, completely independent application programs and data can be provided. On a single central host that hosts multiple users, according to FIG. 2A (see also FIG. 4 of the previously filed application to the same Applicant cited above), the following is preferred:

1. Central Host Application (ref 416 in FIG. 4 of the previously filed patent application to the same Applicant cited above) is shared.
2. Central Host Web Server (ref 412 in FIG. 4 of the previously filed patent application to the same Applicant cited above) is shared.
3. Central Host Message Agent (ref 414 in FIG. 4 of the previously filed patent application to the same Applicant cited above) is shared.
4. The RDBMS, e.g. Oracle Database (ref 418 in FIG. 4 of the previously filed patent application to the same Applicant cited above) may be shared in any of a number of ways:
   (a) There may be one instance of the Database application, running:
   one database that is partitioned for multiple users; or
   one database is set up to have each user with their own separate database file.
   (b) There may be multiple instances of the Database application, each instance of the Database application:
   working on either a single user's database; or
   working on a database that is partitioned; or
   working on separate physical database files for each user.

In essence, all of the central host applications are 'shared'. There is generally only one executable of each program on the central host; multiple external gateway connections generally cause new processes (or instances of the programs) to be spawned which service each individual process or connection. In this sense, they are both 'shared', but different user's data is physically isolated from each other, from a processing perspective.

Gateways

A single user system consists of a central host, gateways, and VIUs as described in the previously filed patent application to the same Applicant cited above. Numeric module identifiers are private within a system. Shared or public gateways in a multi-user system, by definition, form part of more than one user's system (user domain). A multi-user system will thus comprise multiple user domains which can overlap in the gateways. For backward compatibility with single-user systems, each system forming a user domain within a multi-user system retains the autonomy of creating its own, usually sequential, numeric module identifiers. As a result, the same physical gateway will have, generally, different identification numbers within each user's domain. Furthermore, a gateway may be linked (access over the WAN) to different central hosts for different users, hence central hosts must also be distinguished by identifiers. Ultimately, all identifiers must be resolved to a globally unique (usually alphanumeric) name.

FIG. 3 illustrates the format of a gateway VIUPointS table 500. The gateway VIUPointS table 500 shows the linkage between central host names and identifiers for each user of the gateway, and the numeric identifier of the gateway in each user's domain. A VIUPointS table 500, containing data unique to each gateway, is stored in each gateway (for example gateways 404, 406, and 408 of FIG. 2D, all of which are configured to accept the data traffic of more than one user).

The VIUPointS table 500 includes a VIUPointNAME field 502 (Local host name, i.e. the name of the gateway), and a number of user-specific records 504 (two in the present example), one for each user or service provider. Each user-specific record 504 includes the following fields:

506 VIUPoint_ID: Gateway identifier registered with the central host named in this record

508 OVERVIU_NAME Central host name/address in the central host web application

510 OVERVIU_ID Central host numeric identifier

512 PROVIDER_NAME User (service provider) for this gateway (name)

514 PROVIDER_ID User (service provider) for this gateway (numeric identifier)

The field 508 'OVERVIU_NAME' may be used to identify the application in a shared central host running a shared web server, see above. In FIG. 3, VIUPointS table 500, are shown example values for the fields of the table, for the case of two users (or service providers).

Vehicles and VIUs

VIUs are installed in vehicles, and bound logically to that vehicle through the Vehicle Information Number (VIN) in the Central VIUS Table (ref 902, FIG. 9*a* in the previously filed patent application to the same Applicant cited above). As described above, VIUs may communicate with gateways when they are in wireless range, and through the currently communicating gateway upload data to central hosts. In a multi-user system such as any of the multi-user vehicle telemetric systems 60, 70, 80, and 90 described above, or combinations of such systems, there may be more than one central host (or more than one user) authorized to upload data from a given VIU. However, VIUs are not directly "aware" of the number of central hosts. The job of the VIU is to collect vehicle data, and upload the collected data as instructed through a gateway.

Figure 4:
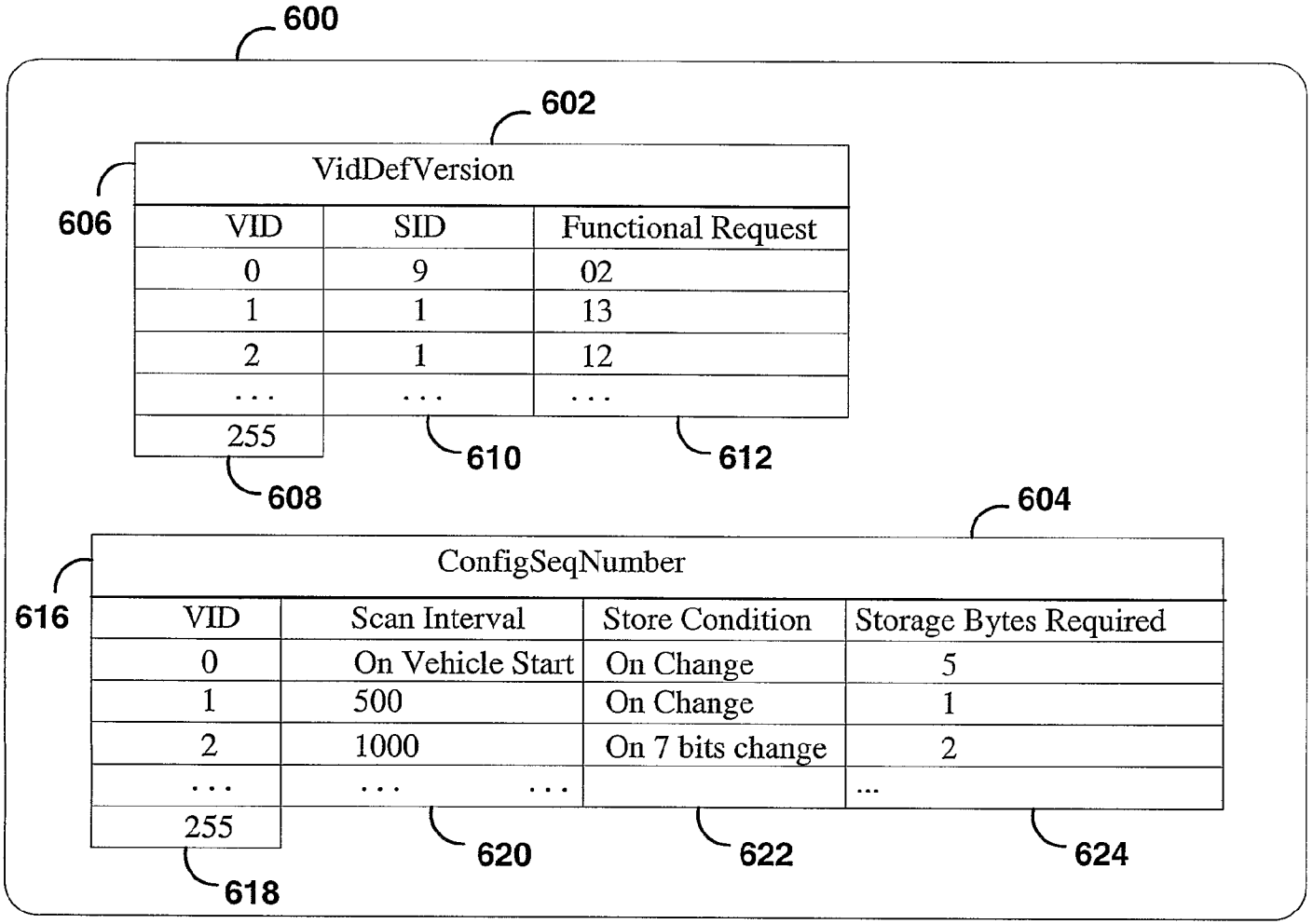
FIG. 4 shows a typical Data Collection Table 600 stored within the VIU of the multi-user vehicle telemetric systems 60, 70, 80, and 90.

In order to allow a VIU to collect data for one or more users, the VIU is equipped with a Data Collection Table (also referred to as a VIU configuration table). FIG. 4 shows a typical Data Collection Table 600 that is stored within the VIU. The Data Collection Table 600 comprises a VID Table 602 and a Sampling Table 604.

In the VID Table 602 are stored a VidDefVersion 606, and three columns of data: a 'VID' column 608 (VID=Value Identifier); a 'SID' column 610 (SID=Service Identifier, also referred to as a 'test mode'); and a 'Functional Request' column 612. Each row of the VID Table 602 defines a set of functional parameters, e.g. what kind of data is sampled by the VIU, the frequency of sampling and the conditions for saving the parameter. The VidDefVersion 606 is a 16 bit (or larger) identifier which is used to uniquely identify a particular set of parameters that can be sampled in a VIU; the VidDefVersion 606 corresponds to the VVI version number described in the Table 1 of the previously filed patent application to the same Applicant cited above. A copy of each uniquely numbered (as defined by VidDefVersion 606) VID Table 602 is stored on the central host. This is necessary to permit decoding of the uploaded VIU data (see detailed description below) before it is inserted into the database on the central host, for subsequent analysis.

The VID Table 602 represents a list of VIU data types, that is unique combinations of SIDs (in the SID column 610) and Functional Requests (in the Functional Request column 612), numbered sequentially by VIDs (in the VID column 608). The VID of 255 indicates the end of table, which allows for variable length tables. In the preferred embodiment, the VID is represented with 8 binary bits, thus allowing for a maximum of 255 valid VID entries that correspond to different VIU data types.

The SID (or test mode) designation is mandated by the SAE (Society of Automotive Engineers) specifications SAE J2190 (Enhanced E/E Diagnostic Test Modes) June 1993 and SAE J1979 (E/E Diagnostic Test Modes) Revised April 2002, and currently ranges in value from 0 to 255. Any of these test modes (SIDs) can be used in the VIU; some are currently allocated for diagnostic use and some are reserved for future use or manufacturer-specific use. Any of the SAE test modes (SIDs) that are to be used for sampling data by the VIU, can be arbitrarily mapped onto a defined or fixed subset (the 'SAE subset') of the available VIDs, e.g. from VID 0 to 200. The remaining VIDs (a 'Netistix subset', e.g. VIDs 201 to 254) have been allocated for other non-SAE mandated data items, generally not provided by data collection via the OBDII port. Using this arrangement, Netistix can create its own definitions for SIDs and Functional Requests. An example of such a data item might be GPS (Global Positioning System) data for the location of a vehicle. The in-vehicle GPS unit is able to directly relay GPS data to the VIU, the OBDII port is not required or used in this data collection application. GPS data might be identified by a VID of 201, and a SID of 0, with the Functional request value being dependent upon the format of the data. For example, a Functional Request value of 0 might indicate that the GPS data is in standard GPS NMEA (National Marine Electronics Association) format, or a Functional Request value of 1 might indicate that the GPS data is in a proprietary binary format. Please note that Netistix's definitions of SIDs and Functional requests can have the same numerical values as defined by the SAE. This does not present a problem, because it is the VID range which indicates whether the SID/Functional request was defined by the SAE standards or by Netistix. Although a maximum of 255 VIDs is supported in the Data Collection Table 600, from a pragmatic operational viewpoint, it is unlikely that 255 unique data items would ever be required to be configured within a single Data Collection Table for simultaneous collection during the operation of a single vehicle.

The Functional Requests, stored in the Functional Request column 612 of the VID Table 602 are generally classified by the SAE as one of the following; PID (Parameter Identifier), OBDMID (On-Board Diagnostic Monitor ID), TID (Test Identifier). The unique combination of SID and Functional Request determine whether it is a PID, TID, INFOTYPE etc.

In the exemplary VID Table 602, VID 0 is mapped onto the SAE's definition of Service identifier (or mode) 9, INFOTYPE 2, which is a generic OBDII request for a vehicle's VIN (Vehicle Identification Number). VID 1 is mapped onto the SAE's definition of Service mode 1, PID 13, which is a generic OBDII request for a vehicle's speed. VID 2 is mapped onto engine RPM, which is mandated by the SAE to be SID 1, PID 12. The VID of 255 in the 'VID' column 608 indicates the end of the table.

When a parameter is sampled via OBDII, it is the VID that is stored in the DPR (DataPoint Record, see the previously filed patent application to the same Applicant cited above), not the SID and Data Request Identifier, along with the actual data within the VIU. This is done to conserve storage space within the VIU and to minimize transmission time (i.e. to efficiently use the available WiFi bandwidth) over the WiFi communication link when the data is uploaded.

The Sampling Table 604 is used to store the sampling frequency and the storage conditions for saving the data to non-volatile (flash) memory in the VIU.

In the Sampling Table 604 are stored a ConfigSeqNumber 616, and four columns of data: a 'VID' column 618; a 'Scan Interval" column 620; a 'Store Condition' column 622; and a 'Storage Bytes Required' column 624. Each row of the Sampling Table 604 defines a set of sampling parameters (collection specification). The ConfigSeqNumber 616 is used to identify a particular set (table) of sampling and storage conditions for a given VidDefVersion 606 of the VID Table 602. There can thus be any of a number of different Sampling Tables 604 associated with a given VID Table 602. Each different version of the Sampling Table 604 that is applicable for a given VID Table 602 will have a unique ConfigSeqNum 616.

A copy of each uniquely numbered (as defined by ConfigSeqNumber 616) Sampling Table 604 is stored on the central host. This is necessary to permit decoding of the uploaded VIU data before it is inserted into the database on the central host, for subsequent analysis. The sampling table is required to be saved on the central host for another reason. If two customers have agreed to 'share' data from the same VIU, but have different data and/or sampling frequency (scan interval) requirements, then the sampling tables of the two customers will be 'merged' at the central host level. The sampling tables from the two customers may reside on the same central host, or they can be on different central hosts. Either way, the sampling tables will be 'shared' between the two customers to derive a single superset of the two data sampling tables.

The VID Table 602 and the Sampling Table 604 that comprise the Data Collection Table 600, are coupled through their respective VIED columns 608 and 618, so that the sampling parameters (defined by a row of the Sampling Table 604) are applied to each corresponding VIU data type (defined by a row of the VID Table 602, having the same VID). One of the reasons that the Data Collection Table 600 is divided into a VID Table (602) and a Sampling Table (604), is to allow for different combinations of unique VID and sampling tables to account for differences in vehicle capabilities.

Another reason that the table is split is into two sections is to decouple the type of data to be sampled from the sampling interval/store conditions. Here are several advantages for doing this:

1. For a given vehicle: There may be a requirement for different scan intervals and store conditions if there is a performance problem (i.e. a problem with the engine) versus when the engine is operating properly. For example, the fleet manager might want to change the store condition for a given parameter from 'on 7 bits change', for normal vehicle operation, to 'always save' for abnormal vehicle operation.
2. Two customers agree to have access to data from the same VIUs. Both want the same data, but have requirements for different scan intervals. In both cases, each customer's VID table is the same, but their Sampling Tables differ. When the superset of the Data Collection Table is created (which will satisfy both customer's requirements), the VID table remains the same, but the Sampling Table is updated. What has to be stored on the central host (assuming a shared central host for both customers) is:

(i) A copy of the VID table (note: this is the same for both customers)
(ii) A copy of the sampling table for customer #1
(iii) A copy of the sampling table for customer #2
(iv) A copy of the sampling table for customer#1+customer #2 (a superset)

This requires less database storage space than the alternative method:

(a) A copy of the data sampling table for customer #1 (which includes a VID table and a sampling table);
(b) A copy of the data sampling table for customer #2 (which includes a VID table and a sampling table); and
(c) A copy of the data sampling table for customers #1+#2 (which includes a VID table and a sampling table)

3. The use of a split data sampling table also means that when a configuration change is required in the VIU, it can often minimize the amount of configuration data required to be downloaded to the VIU (to make efficient use of the WiFi communication link). For example, if only the sampling portion of the data sampling table has to be updated, generally, less data would have to be downloaded to the VIU than if the entire data sampling table has to be downloaded all the time.

In the 'Scan Interval' column 620 of the Sampling Table 604, is given the minimum sampling rate (e.g. scan interval time in milliseconds) that the corresponding functional parameter of the VID Table 602 is polled via the OBDII port of the VIU.

The 'Store Condition', given in the 'Store Condition' column 622 of the Sampling Table 604, is the trigger or logical condition for storing a parameter's current value when compared with the previous sample. For example, if the RPM value is different than the previous value ('On Change'), or different by some delta value (e.g. 'On 7 bits change'), then the current RPM value will be saved within the VIU.

The 'Storage Bytes Required' column 624 of the Sampling Table 604 gives the number of bytes required for storage in the non-volatile (flash) memory of the VIU. This the number of bytes that are required to store the 'raw' parameter DataPoint acquired via the OBDII port.

The VID of 255 in the 'VID' column 618 of the Sampling Table 604 indicates the end of the table. This allows for variable length tables. In an 8 bit VID representation, there can thus be 255 valid VID entries (0-254). If more entries are required, the VID could be a 16 bit or larger number.

Figure 5:
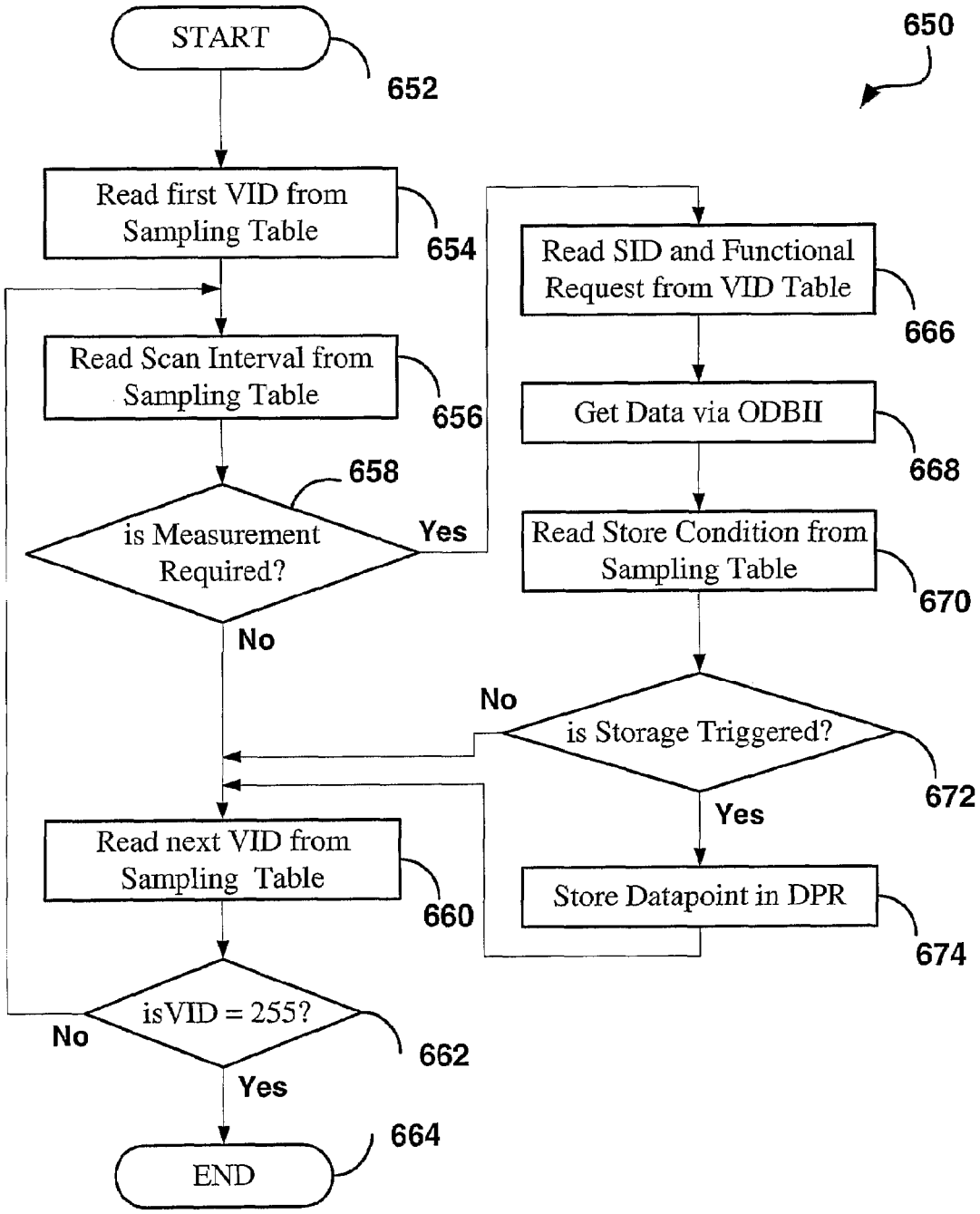
FIG. 5 shows a data collection process 650 of a VIU of the multi-user vehicle telemetric systems 60, 70, 80, and 90.
Figure 6:
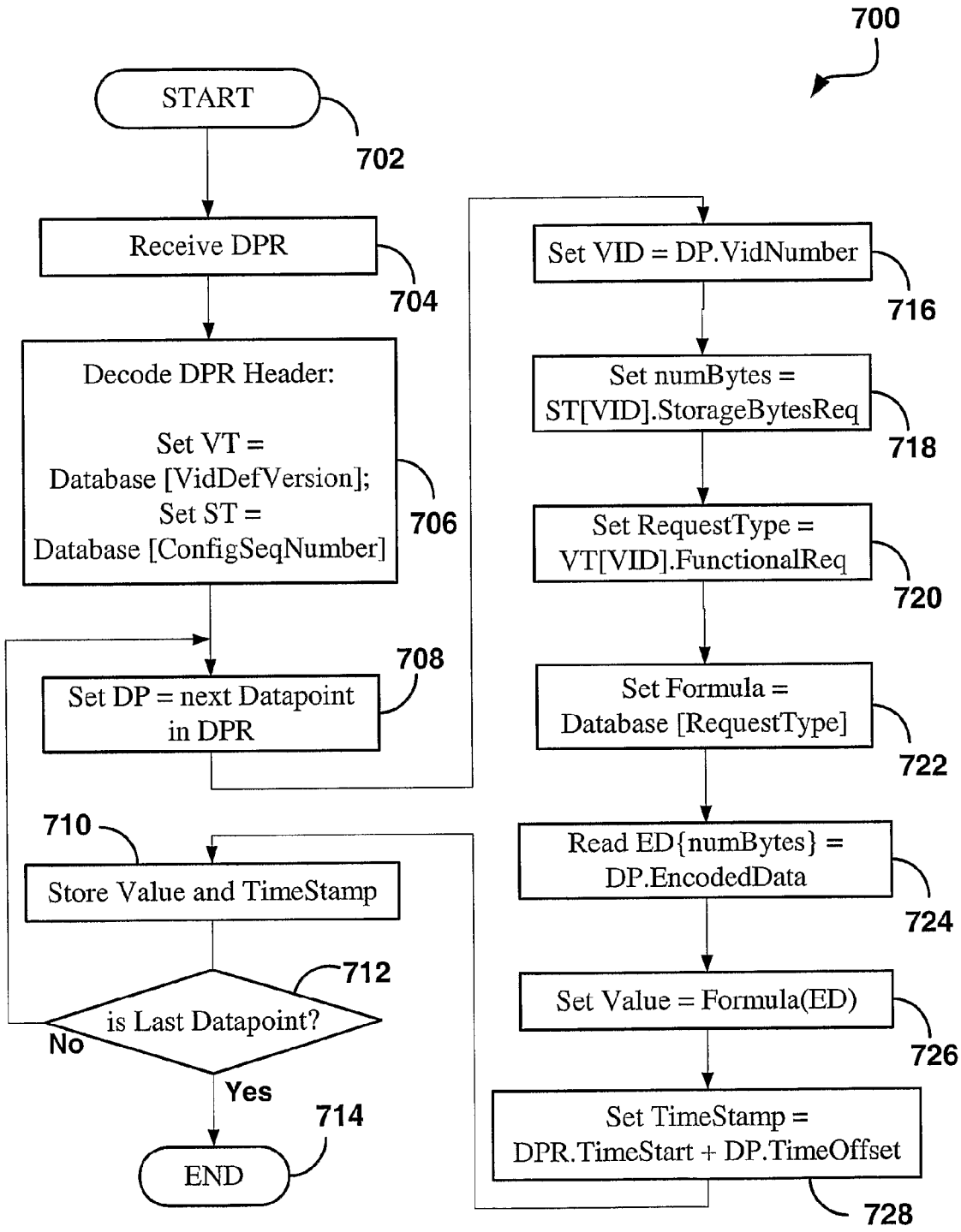
FIG. 6 shows a Data Receiving process 700 of a central host of the multi-user vehicle telemetric systems 60, 70, 80, and 90.

FIGS. 5 and 6 illustrate processes running in the VIU and the central host respectively, showing the use of the Data Collection Tables 600, i.e. the VID Table 602 and the Sampling Table 604, identical copies of each exist in the VIU and the central host. This is a simplified description of the data collection (VIU) and decoding (central host) functionality, not taking into account the multi-user aspect which is described further down.

FIG. 5 shows a data collection process 650 of the VIU, which may be triggered by the operating system in the VIU to run periodically. The purpose of the process 650 is to scan the Data Collection Table 600 (which includes the VID Table 602 and the Sampling Table 604) and, as specified by the table, collect vehicle data and store them into a DataPoint record (DPR) for later delivery to a central host. The data collection process 650 comprises the following steps:

652 "START";
654 "Read first VID from Sampling Table";
656 "Read Scan Interval from Sampling Table";
658 "is Measurement Required?", a decision step;
660 "Read next VID from Sampling Table";
662 "is VID=255?", a decision step;
664 "END";
666 "Read SID and Functional Request from VID Table";
668 "Get Data via ODBII";
670 "Read Store Condition from Sampling Table";
672 "is Storage Triggered?", a decision step; and
674 "Store DataPoint in DPR".

The data collection process 650 runs from "START" 652 to "END" 664, doing a single scan of the Data Collection Table 600. After "START" 652, the step 654 "Read first VID from Sampling Table" is executed. Usually the first VID is 0, see the VID Column 618 of the Sampling Table 604, FIG. 4. The process could equally well read the VID from the VID Column 608 of the VID Table 602, as these columns are always the same.

Please note that although the VIDs could be allocated in any order within the allowable range, it might make sense, from a practical implementation viewpoint, to start at 0. There may also be numerical gaps in the VIDS, as Netistix has a range of VIDs set aside for our own definition.

In the next step, 656 "Read Scan Interval from Sampling Table", it is determined for the current VID row if the elapsed time (tracked by the operating system) indicates that a measurement (or other vehicle data sample) should be taken.

Please note that instead of an operating system for tracking elapsed time, the VIU may have a simple state-machine or task scheduler.

Accordingly, the decision step 658 "is Measurement Required?" will guide the process. If the decision is "No", the step 660 "Read next VID from Sampling Table" is taken. If the next VID is 255 (decision step 662 "is VID=255?") then the process is finished and proceeds to the "END" step 664, otherwise it loops back to the step 660 "Read next VID from Sampling Table".

If the decision from the decision step 658 "is Measurement Required?" is "Yes", then the SID and Functional Requests (Columns 610 and 612 of the VID Table 602) are read in the step 666 "Read SID and Functional Request from VID Table". In the next step 668 "Get Data via ODBII", a data request is sent from the VIU to the vehicle over the ODBII port to obtain the data item defined in the VID Table.

Depending on the Store Condition (column 622 of the Sampling Table 604), read in the step 670 "Read Store Condition from Sampling Table" and tested in the decision step 672 "is Storage Triggered?", the data is stored in the current DataPoint record ("Yes" from the decision step 672 "is Storage Triggered?", followed by the step 674 "Store DataPoint in DPR"), or the process continues to loop ("No" from the decision step 672 "is Storage Triggered?", followed by the step 660 "Read next VID from Sampling Table", see above).

Ultimately, the end of the Sampling Table 604 will be reached (decision step 662 "is VID=255?"), and the process will end at the "END" step 664, to be restarted by the operating system or task scheduler immediately again (Step 652 'START').

The task loop is endless. As soon as the last item is sampled, it will revert back to the beginning of the table with no time delay. It is understood that it is not possible to ask for another data item while the ODBII bus is busy or while waiting for a response from the bus. Because of the asynchronous and non-deterministic (in terms of the time for a response) nature of the OBDII bus, it is sometimes necessary to drop a scheduled OBDII data request from our request queue, because of the possibility of us getting hopelessly 'behind' in the scheduling. Legacy OBDII data requests and responses typically happen at a rate of about 5 requests/responses per second. With the latest bus that is being implemented in North America on all vehicles (by 2007), known as the CAN (controller area network) bus, the number of data requests that can be handled via OBDII will be much higher.

When the VIU wirelessly uploads the vehicle data to the gateway and thence to a central host, the ConfigSeqNum 616 and the unique VidDefVersion number 606 are included in the message header bytes of each DataPoint Record (DPR). The detailed description of DPRs, their format and usage are provided in the previously filed patent application to the same Applicant cited above. The ConfigSeqNum 616 and VidDefVersion 606 numbers are included in the DPR format to permit the central host to select the corresponding copies of the VID Table 602 and of the Sampling Table 604 to use when decoding the raw VIU data.

FIG. 6 shows a Data Receiving process 700 running in a central host. It may be triggered by the arrival of a DPR containing raw vehicle data from a vehicle (VIU) via a gateway. The purpose of the process 700 is to scan and decode the received DPR, and to store the decoded vehicle data in the central host database for subsequent analysis. The Data Receiving process 700 comprises the following steps:

702 "START";
704 "Receive DPR";
706 "Decode DPR Header";
708 "Set DP";
710 "Store Value and TimeStamp";
712 "is Last DataPoint?";
714 "END";
716 "Set VID";
718 "Set numBytes";
720 "Set RequestType";
722 "Set Formula";
724 "Read ED";
726 "Set Value"; and
728 "Set TimeStamp".

The Data Receiving process 700 runs from "START" 702 to "END" 714, digesting a single DataPoint Record (DPR). After "START" 702 a DPR is received (the step 704 "Receive DPR") and the step 706 "Decode DPR Header" is executed. In this step the fields of the DPR header are processed, including the VidDefVersion and the ConfigSeqNumber. The local Database of the central host includes a copy of at least one VID Table, and must contain a copy of the VID Table 602 that corresponds to the VID Table 602 of the VIU from which the DPR was received. Similarly, a copy of the SamplingTable 604 is available in the central host Database. The process computes references "VT" and "ST" to the local VID and Sampling Tables indicated by the received VidDefVersion and the ConfigSeqNumber respectively. The notation using square brackets ("[" and "]") in FIG. 6 denotes indexing or lookup, as is conventional in many programming languages.

The processing of the other fields of the DPR header is of less relevance here and not described in detail.

The step 708 "Set DP" sets a reference "DP" to the next (or first) DataPoint field in the DPR. This is followed by the steps 716-728 which decode the DataPoint, resulting in a "Value" and a "Timestamp", both of which are stored in the database of the central host in the step 710 "Store Value and TimeStamp". If the processed DataPoint is the last DataPoint of the DPR ("Yes" from the decision step 712 "is Last DataPoint?"), then the process is finished (the step 714 "END"), otherwise ("No" from the decision step 712 "is Last DataPoint?") the process loops back to the step 708 "Read DP".

The sequence of the steps 716 to 728 are executed in sequence to decode the DataPoint referenced by "DP".

In the step 716 "Set VID", a variable "VID" is read directly from the VidNumber field of the DataPoint referenced by DP. The notation using a period (".") in FIG. 6, as in "DP.VidNumber" denotes a field (i.e. "VidNumber") of a record (i.e. "DP"), as is conventional in many programming languages.

In the step 718 "Set numBytes", a variable "numBytes" is read from the "Storage Bytes Required" column of the Sampling Table referenced by "ST", and more specifically the database record (row) indexed by the variable "VID" as indicated by the notation ST[VID]. StorageBytesRequired shown in FIG. 6.

In a similar way, in the step 720 "Set RequestType" a variable "RequestType" is read from the database VID Table referenced by "VT", and more specifically the database record (row) indexed by the variable "VID" as indicated by the notation VT[VID].FunctionalRequest.

The request type determines the formula or algorithm that is used to convert (i.e. decode) the raw encoded data of the DataPoint into a "Value" of a form required for subsequent analysis or display. In the step 722 "Set Formula", a reference "Formula" is read from the central host database which contains the required formulas, indexed by the variable "RequestType" together with the SID value. Please note that two different SIDs can have the same request type, but different formulae to decode the values.

In the step 724 "Read ED", the encoded data are copied from the "EncodedData" field of the DataPoint "DP" and assigned to an array "ED{numBytes}", where the curly brackets ("{" and "}") indicate the length of the array. The length of encoded data of each data type is provided in the Sampling Table; the number of bytes for the particular DataPoint "DP" were already determined in the step 718 "Set numBytes" above.

In the step 726 "Set Value", the array ED containing the raw encoded values is used in combination with the "Formula" (determined in the step 722 "Set Formula") to generate the "Value" that will be stored in the database (see step 710 "Store Value and TimeStamp").

Similarly, in the 728 "Set TimeStamp", the "TimeStart" field of the DPR header (DPR.TimeStart) is combined by simple addition with the "TimeOffset" field of the DataPoint referenced by DP, to generate the "TimeStamp" that will be stored in the database.

A simple example is given to show the use of the Data Collection Table 600 to collect data in the VIU according to the data collection process 650 (FIG. 5) and then decode it according to the Data Receiving process 700 (FIG. 6) in the central host.

As shown in the VID Table 602 (FIG. 4), VID #2 defines engine RPM (SID 1, PID 12). After the VIU requests the RPM data via the OBDII port, it receives two data bytes ('A" and 'B') in the response message. In the VIU, the bytes are sequentially stored as a single DataPoint (see the DataPoint description in the previously filed patent application to the same Applicant cited above): VidNumber, TimeOffset, data byte A, data byte B. The data bytes A and B constitute the encoded data of the DataPoint. In the header of the DPR, the VidDefVersion and ConfigSeqNum are also stored.

After the data is uploaded to the central host, the central host attempts to decode the DPR to store the data in the database. It knows from the header information which VID Table (via VidDefVersion) was used to create the information. It looks up VID #2 in the VID Table Database and determines (via table look-up) that 2 bytes of data follow the VID (VID=2) and TimeOffset fields. The central host determines that it is a generic SAE OBDII data request and looks up (in the database of SAE generic and proprietary information that is stored on the central host, and which was created by Netistix) the decoding information for RPM, represented by the formula: RPM=((A*256)+B)/4. In other words, the scaling per bit is ¼ bit per RPM, with byte 'A' being the most significant byte. The central host then stores the time-stamped, and decoded RPM value into the database for subsequent data analysis.

As described above, the role of the Data Collection Table 600 is to define for the VIU the type and frequency of data to be collected, and for the central host to decode the received data using the same Data Collection Table information that is referenced by the ConfigSeqNum and VidDefVersion numbers provided in each received DPR.

If a new Data Collection Table 600 is downloaded to the VIU, then the current DataPoint Record (accumulated collected vehicle data that are ready to be uploaded) is closed off using the previous Data Collection Table information (i.e. VidDefVersion 606 and ConfigSeqNum 616) in the DPR header bytes. Subsequent DataPoint records will be collected using the new Data Collection Table information.

Gateway Functionality in a Multi-User Application

The description of the VIU and central host roles in the collection and decoding of vehicle data applies to both a single-user and a multi-user system: the VIU collects and uploads data in the form of DPRs when requested by a gateway as described here and in the previously filed patent application to the same Applicant cited above. A central host, or equivalently a virtual host as described above, receives DPRs and decodes and stores the data in its database.

In the multi-user system, users running on different central hosts may share access to data on the same vehicles (are authorized to access the same VIUs), but may not want to access the same set of data. In fact, different users are likely to require different measurements or different sampling intervals.

The Data Collection Tables 600 that are installed in the VIUs of a specific vehicles accessible to several users, are supersets of the requirements of these users. That is if a user "A" requires a measurement "MA", and a user "B" requires a measurement "MB", both measurements "MA" and "MB" will be contained in the Data Collection Table in the VIU. Furthermore if the user "A" requires a measurement "X" at a sampling rate "SA", and the user "B" requires the same measurement "X' but at a different sampling rate "SB", the Data Collection Table in the VIU will specify the sampling rate of "SA" or "SB", whichever is higher.

On the other hand, the Data Collection Tables 600 that are available in the central hosts must match those installed in the VIUs, having the same VidDefVersion and the ConfigSeqNumber. However, not all measurements shown in the Data Collection Tables 600 that are installed in the VIUs are necessarily of interest to all authorized users.

In the preferred implementation, all central hosts (i.e. users) who wish to share access to data on the same vehicles, cooperate with each other, or with a third party, such as Netistix. They each create their private Data Collection Tables and then create a combined Data Collection Table that contains all required measurements, at the highest required sampling rates, for deployment to all central hosts, and to the VIUs while avoiding the duplication of data collection within the vehicle for various central hosts. Each user also retains a copy of their original Data Collection Table in their respective central hosts.

The VIUs will then perform all required measurements at the required sampling rates, and send the resulting DPRs to the gateways. The gateways relay the data from the VIUs to central hosts, and through user (central host) specific data collection profiles ('profiles' in short) that are compiled in the central hosts and stored in the gateways. The gateways are thus in a position to suppress (filter) data contained in the DPRs received from the VIUs. A profile installed in each shared gateway contains the information to allow filtering of the DPRs as they pass through the gateway, in a way that provides each user with only the data (i.e. all or only a subset of the data received from the VIUs) that were requested in their original (private) Data Collection Tables. The profiles are referenced in a modified VIUs table (see Gateway VIUs table, FIG. 9*d* of the previously filed patent application to the same Applicant cited above). The modified VIUs table has additional fields providing the identifiers of the VIUs and the central host for each authorized user.

FIG. 7 shows the format of a Modified VIUs table 800 in a gateway. For convenience, the Gateway VIUs table, FIG. 9*d* of the previously filed patent application to the same Applicant cited above) is replicated here, shown in dotted outline (reference numeral 802), and corresponding fields of the two tables are joined by lines. Although the names of these corresponding fields may have changed, their functions (with one exception) remain unchanged.

The Modified VIUs table 800 contains the names of the columns of a database table in the gateway which holds data specific to each VIU that is authorized to access this gateway. Data for each such VIU is stored in one row per each central host (user) that is authorized to access the VIU via this gateway. This will be illustrated below with an example.

First, attention is drawn to the following fields of the Modified VIUs table 800:

804 "VIU_id"
806 "Programmed_profile_id";
809 "Present_profile_id";
810 "Gateway_id"; and
812 "Central_host_id".

The fields 806 "Programmed_profile_id" and 808 "Present_profile_id" contain a numeric identifier of a profile (described below). The present profile defines the currently active profile residing on the VIU, while the programmed profile may be installed when a change in profiles is required.

The "VIU_id" field 804, the "Gateway_id" field 810, and the "Central_host_id" field 812 provide the reference identifiers for the present VIU, gateway, and central host (user) respectively. As indicated above, each user domain may have a private set of identifiers of the VIUs and gateways, while the identifiers of the central hosts must be globally (multi-user system wide) unique.

The FIG. 8 shows an illustrative example 820 of the Modified VIUs table 800, showing the entries for a VIU which is authorized to be accessed by two central hosts.

The first row of the illustrative example 820 shows the column headers, corresponding to the fields of the Modified VIUs table 800 of FIG. 7, and indicated by the same names and reference numbers.

In this example, the second row indicates that the VIU #4 (column headed by the "VIU_id" field 804) may be accessed by the central host #1 (column headed by the "Central_host_id" field 810) through the gateway #2 (column headed by the "Gateway_id" field 810) using profile #11 (column headed by the "Present_profile_id" field 808). Similarly, the second row indicates that the VIU #4 may be accessed by the central host #2 through the gateway #21, using profile #12.

The identifier for the VIU (#4) happens to be the same in both cases, but it is not necessary that VIUs have globally unique identifiers. The identifier for the gateway (the gateway that this table is installed in) is #2 in the first case, but #21 in the second. The identifiers of the central hosts which must be globally unique are #1 and #2 respectively. The profile identifiers (#11 and #12 respectively) indicate that the two users (corresponding to the two central hosts) have different data collection requirements expressed in their respective profiles for this VIU.

FIG. 9 shows an example of a Profiles Table 900. Shown in FIG. 9 are the column headers (names of fields) and a number of example profiles. The fields of the Profiles Table 900 are: "Profile_id"; "Profile_name"; "Profile_description"; "Service_id"; "Profile_data"; and "Profile_timestamp".

Each profile, identified by the entry under the heading "Profile_id" in the Profiles Table 900 is available to be referenced by the "Programmed_profile_id" field 806 or the "Present_profile_id" field 808 of the Modified VIUs table 800. The entries under the headings "Profile_name", "Profile_description", and "Profile_timestamp" serve the administrative functions indicated by their names. The numerical entries under the heading "Service_id" point to a "Services" table (not shown) which is used to bundle one or more profiles under a "Service Name".

Each entry under the heading "Profile_data" in the Profiles Table 900 is a list of VIDs (see Data Collection Table 600) of the tests or measurements that are included in this profile. Note that the Data Collection Table 600 of a VIU is sequentially numbered with VIDs that identify the individual tests or measurements required in this VIU. The "Profile_data" in the Profiles Table 900 allows a subset of these tests to be identified.

Although the "profile data" in the Profiles Table 900 has been described as list of VIDs, other more optimized implementations of the profile data will occur to practitioners skilled in the art. For example, the data may be stored in the form of a bit map, each bit representing one possible VID. In this way, memory may be conserved, and the matching of DataPoint VidNumbers against the profile data is faster. This alternative representation is advantageous when the number of sequentially numbered DataPoints is relatively small.

The individual "Profile_data" in the Profiles Table 900 reflect the contents of the private Data Collection Tables of each user, and can be created at the time the private Data Collection Tables are coordinated to create the combined Data Collection Tables, representing in effect a combined data collection profile for each VIU.

When a DPR is received by the gateway from a VIU the Modified VIUs table 800 and the Profiles Table 900 are consulted in processing (filtering) and forwarding the DPR to one or more central hosts. In this way, although a full DPR is received from the VIU, only the subset corresponding to the applicable profile is forwarded to each central host, to satisfy the requirement of the central host, while suppressing the measurements that are contained in the DPR but are not required by that central host.

FIG. 10 shows a Forwarding Process 930, running in a shared gateway. It is triggered by the arrival of a DPR containing raw vehicle data from a vehicle (VIU). The purpose of the process 930 is to do the following:

(a) identify the central hosts that the incoming DPR is relevant to;

(b) identify the profiles corresponding to each central host;

(c) scan the incoming DPR; and (d) store each DataPoint containing vehicle data into an outgoing DPR for each central host only if the VID of the DataPoint is contained in the corresponding profile.

The format of the DPR including a header and a sequence of DataPoints, is described in FIG. 2 of the previously filed patent application to the same Applicant cited above.

The Forwarding Process 930 comprises the following steps:

932 "START";
934 "Receive incoming DPR";
936 "Decode DPR header";
938 "Select first host";
940 "Select profile";
942 "Read next DataPoint (DP)";
944 "is DP in profile?";
946 "copy DP to outgoing DPR";
948 "is last DataPoint?";
950 "Send DP to host";
952 "is last Host?";
954 "Select next host"; and
956 "END".

The Forwarding Process 930 is triggered by the arrival of a DPR in the gateway over the wireless link from a VIU (the steps "START" 932 and "Receive incoming DPR" 934). The DPR header includes the VIU serial number (ViuSN) which in the step "Decode DPR header" 936 is matched against the Modified VIUs Table 800 to extract a subset VIUs Table (VS) which contains all records containing the same VIU_serial_number as the DPR header. Each of the VS records contains a central_host_id thus identifying a current central host which can be further specified through the VIUPointS table 500.

An outer loop is then executed (the steps 940 to 954) processing the entire DPR for each of the hosts in the subset VIUs Table (VS) as follows. In the step "Select profile" 940 the present_profile_id corresponding to the selected central host is selected in the subset VIUs Table (VS), and matched against a corresponding profile_id in the Profiles Table 900. This provides the current profile (under the "Profile_data" column of the Profiles Table 900) that will be used in the subsequent steps.

The steps 942 to 952 constitute an inner loop for the purpose of scanning the incoming DPR and analyze each DataPoint of the incoming DPR in order to copy it to an outgoing DPR only if the DataPoint VID is included in the current profile, as follows. In the step "Read next DataPoint (DP)" 942, the first (and every subsequent) DataPoint is read from the DPR (pointer DP); if the identifier of the DataPoint (DP) VidNumber is found in the Profiles Table 900 ("yes" from the decision step "is DP in profile?" 944) then the DataPoint is accepted and used to start an outgoing DPR, or added to the outgoing DPR if it is not the first DataPoint accepted. If the identifier of the DataPoint (DP) VidNumber is not found in the Profiles Table 900 ("no" from the decision step "is DP in profile?" 944) then the DataPoint is not accepted, and not included in the outgoing DPR.

If the DataPoint is not the last DataPoint of the DPR ('no" from the decision step "is last DataPoint?" 948), the inner loop continues from the top with the step "Read next DataPoint (DP)" 942.

If it is the last DataPoint of the DPR ("yes" from the decision step "is last DataPoint?" 948), the DPR has been scanned, and an outgoing DPR has been accumulated that is sent to the current central host in the step "Send DP to host" 950. If this is the last host listed in the subset VIUs Table (VS) ("yes" from the decision step "is last Host?" 952) then the Forwarding Process 930 is finished, otherwise ("no" from the decision step "is last Host?" 952) the next host is selected from the subset VIUs Table (VS) in the step "Select next host" 954, and the outer loop recommences with the step "Select profile" 940.

Expressed in other words, the outer loop processing (Steps 940-954) is spanned across the current gateway and the linked central hosts. The gateway loops over the central hosts to send notification about data being available for an upload. Each participating central host will request DPRs from the gateway. The gateway matches host id and VIU id with the VIUs table residing on the gateway. If the match is found, the gateway will reply to the hosts' request with the appropriate set of DPRs. A single outer loop iteration on the diagram is equivalent to a single host upload request presented to the gateway.

In the foregoing are described the shared gateways, the multiple and shared central hosts, and the data organization and methods used in VIUs, gateways, and central hosts, thus providing a multi-user motor vehicle telemetric system and a method that allows many combinations of exclusive or shared resources (VIUs, gateways, and central hosts) to serve multiple users in the collection of vehicle data. Each user has secure, reliable, and independent access to their authorized vehicle data directly, while the system may be configured with a choice of exclusive and shared resources such as VIUs, gateways and central hosts.

Although the preferred embodiment employs the 802.11b WiFi link protocol, it is within the scope of the invention that other wireless link protocol can also be used. In the preferred embodiment, any of the 802.11a or 802.11b or 802.11g WiFi links could be used without changes to the software.

Although specific embodiments of the invention have been described in detail, it will be apparent to one skilled in the art that variations and modifications to the embodiments may be made within the scope of the following claims.

What is claimed is:

1. A multi-user motor vehicle telemetric system, comprising:

(a) one or more central hosts connected to a communications network, each central host being associated with one or more users of the system;

(b) one or more gateways connected to the communications network, the communications network enabling the transfer of data between the gateways and the central hosts;

(c) one or more vehicle interface units (VIUs), each placed within a vehicle having access to sensors in the vehicle for collecting vehicle related data, each VIU having means for communication over a wireless link to gateways designated to be accessed by said each VIU when the VIU of the vehicle is within a transmission range of one of said designated gateways, and wherein each VIU is associated with one or more of the users;

(d) each central host having means for selecting gateways for collecting data from each VIU which is associated with the users that the central host is associated with;

(e) each central host having means allowing each user to specify the data to be collected from its associated VIUs through a data collection profile which is stored in the central host and the selected gateways;

(f) each gateway having means for recognizing the association between central hosts and VIUs belonging to the same user; and (g) each VIU having a means for collecting the data, which is required to be collected according to a combined data collection profile for all users associated with said each VIU.

2. A system as described in claim 1, wherein the means (g) comprises a means for collecting the data, which is required to be collected according to a combined data collection profile, which is formed so that to avoid a duplication of data to be collected by each VIU between the users associated with said each VIU.

3. A system as described in claim 1, wherein some or all of the selected gateways are shared between two or more users.

4. A system as described in claim 1, wherein the selected gateways process the collected data according to the data collection profiles related to each of the users, and forward the processed data to the central hosts associated with the respective users.

5. A system as described in claim 1, comprising only one central host.

6. A system as described in claim 3, wherein all gateways are shared by all users.

7. A system as described in claim 1, wherein some users are associated with more than one central host.

8. A system as described in claim 1, wherein each central host is associated with only one user.

9. A system as described in claim 1, wherein each VIU is associated with only one user.

10. A system as described in claim 4, wherein each gateway has means for determining the associated VIUs and the central hosts.

11. A system as described in claim 10, wherein the means for determining includes means for processing the data received from the associate VIUs and forwarding respective subsets of the data to associated central hosts according to the data collection profiles related to each user that the central host is associated with.

12. A system as described in claim 10, wherein the means for determining comprises a database stored in a computer memory along with a software for data processing.

13. A system as described in claim 1, wherein the means in the VIU comprises a data collection table stored in a memory and a control program therefor.

14. A system as described in claim 13, wherein the data collection table comprises an entry for each type of data to be collected, and a collection specification regarding the time interval and the condition for performing the data collection and storage for each type of data to be collected.

15. A system as described in claim 14, wherein the entry for each type of data to be collected comprises a value identifier linking the type of data to be collected and the collection specification to the data collection profile.

16. A system as described in claim 15, wherein the entry for each type of data comprises designations specified by SAE (Society of Automotive Engineers).

17. A system as described in claim 1, wherein the access to sensors is provided by an OBD-II bus.

18. A vehicle interface unit (VIU) for a multi-user motor vehicle telemetric system, comprising one or more central hosts connected to a communications network, each central host being associated with one or more users of the system, one or more gateways connected to the communications network, the communications network enabling the transfer of data between the gateways and the central hosts, the VIU being placed within a vehicle and having access to sensors in the vehicle for collecting vehicle related data, the VIU further having means for communication over a wireless link to gateways to be accessed by the VIU when the VIU of the vehicle is within a transmission range of one of said gateways, and wherein each VIU is associated with one or more of the users, each central host having means allowing each user to specify the data to be collected from its associated VIUs through individual data collection profiles which are stored in the central host and the gateways and forming a combined data collection profile forwarded to the VIU, the VIU comprising:

(a) means for storing the combined data collection profile; and (b) means for collecting the data required to be collected from the vehicle according to the combined data collection profile for all users associated with said VIU.

19. A VIU as described in claim 18, wherein the combined data collection profile comprises a data collection table stored in a memory and a control program therefor.

20. A VIU as described in claim 19, wherein the data collection table comprises an entry for each type of data to be collected, and a collection specification regarding the time interval and the condition for performing the data collection and storage for each type of data to be collected.

21. A VIU as described in claim 20, wherein the entry for each type of data to be collected comprises a value identifier linking the type of data to be collected and the collection specification to the data collection profile.

22. A VIU as described in claim 20, wherein the entry for each type of data comprises designations specified by SAE (Society of Automotive Engineers).

23. A VIU as described in claim 18, wherein the access to sensors is provided by OBD-II bus.

24. A method for collecting vehicle performance data in a multi-user motor vehicle telemetric system, comprising one or more central hosts connected to a communications network, each central host being associated with one or more users of the system, one or more gateways connected to the communications network, the communications network enabling the transfer of data between the gateways and the central hosts, one or more vehicle interface units (VIUs), each placed within a vehicle having access to sensors in the vehicle for collecting vehicle related data, each VIU having means for communication over a wireless link to gateways designated to be accessed by said each VIU when the VIU of the vehicle is within a transmission range of one of said designated gateways, and wherein each VIU is associated with one or more of the users, the method comprising:

(a) at each central host, selecting gateways for collecting data from each VIU which is associated with the users that the central host is associated with;

(b) at each central host specifying for each user the data to be collected from its associated VIUs through data collection profiles which are stored in the central host and the selected gateways;

(c) at each gateway determining the association between central hosts and Vius belonging to the same user; and (d) at each VIU, collecting the data required to be collected according to a combined data collection profile for all users associated with said each VIU.

25. A method as described in claim 24, further comprising the steps of: receiving the collected data from said each VIU; determining the central hosts which have the same user as the VIU; for each host, filtering the collected data according to the data collection profile for that host; and forwarding the filtered data to said each central host.

26. A method as described in claim 25, wherein the step of filtering comprises decoding and storing the data.

27. A method as described in claim 24, wherein the step (b) further comprises the step of forming a data collection table based on the combined data collection profile, the data collection table comprising an entry for each type of data to be collected, and a collection specification regarding the time interval and the condition for performing the data collection and storage for each type of data to be collected.

28. A method as described in claim 27, wherein the step of forming comprises introducing for each type of data to be collected a value identifier linking the type of data to be collected and the collection specification to the data collection profile.

29. A method as described in claim 27, wherein the step (d) comprises reading the data collection table, and for each type of data to be collected and the collection specification, collecting the data accordingly and storing it in a memory.

30. A system as described in claim 1, wherein the gateway serves more than one user, the gateway comprising:

(a) means for determining if the gateway is authorized to be accessed by said each VIU when the VIU of the vehicle is within a transmission range of said gateway, (b) means for receiving the collected vehicle related data from said VIU, and processing and forwarding the processed data to the central hosts associated with same users that said each VIU is associated with, in accordance with the data collection profiles.

31. A system as described in claim 30, wherein the means (a) comprises a database stored in a computer memory along with a software for data processing.

* * * * *